US008176855B1

(12) United States Patent
Cannon et al.

(10) Patent No.: US 8,176,855 B1
(45) Date of Patent: May 15, 2012

(54) FOOD AND BEVERAGE TRAY

(75) Inventors: Jonathan W. Cannon, Raleigh, NC (US); Paul Bradley Forrest, Cary, NC (US); William L. Dungan, Cary, NC (US); Michael Ross Dickson, Cary, NC (US)

(73) Assignee: 1 Mustard Seed, LLC, Greensboro, NC (US)

( * ) Notice: Subject to any disclaimer, the term of this patent is extended or adjusted under 35 U.S.C. 154(b) by 386 days.

(21) Appl. No.: 12/583,410

(22) Filed: Aug. 20, 2009

Related U.S. Application Data

(60) Provisional application No. 61/200,605, filed on Dec. 2, 2008.

(51) Int. Cl.
*A47B 85/00* (2006.01)

(52) U.S. Cl. ..... 108/25; 229/117.08

(58) Field of Classification Search ..... 108/25, 108/26, 132, 129, 117, 35, 38; 206/562, 206/565; 220/737, 738, 739; 224/906; 229/117.08, 229/120.15
See application file for complete search history.

(56) References Cited

U.S. PATENT DOCUMENTS

| | | | | |
|---|---|---|---|---|
| 1,709,928 | A | 4/1929 | Whitney | |
| 2,039,922 | A | 5/1936 | Neats et al. | |
| 2,586,301 | A * | 2/1952 | Castle | 229/120.22 |
| 2,787,507 | A | 4/1957 | Powers | |
| 2,822,106 | A | 2/1958 | Fabian et al. | |
| 2,823,087 | A | 2/1958 | Zimmer | |
| 3,883,029 | A | 5/1975 | Wyatt | |
| 4,122,780 | A * | 10/1978 | Brickman | 108/25 |
| 4,183,444 | A | 1/1980 | English et al. | |
| 4,557,200 | A | 12/1985 | Geschwender | |
| 4,863,094 | A | 9/1989 | Morrow et al. | |
| 4,940,003 | A | 7/1990 | Mayhew et al. | |
| 4,946,094 | A | 8/1990 | Stang | |
| 4,953,473 | A | 9/1990 | Tomaka et al. | |
| 5,118,063 | A | 6/1992 | Young, Sr. | |
| 5,348,218 | A | 9/1994 | Haire et al. | |
| D352,213 | S | 11/1994 | Keven | |
| 5,383,411 | A * | 1/1995 | Tomaka et al. | 108/132 |
| 5,425,455 | A | 6/1995 | Miller et al. | |
| 5,429,261 | A | 7/1995 | Machino | |
| D360,776 | S | 8/1995 | Blue | |
| 5,524,814 | A * | 6/1996 | Davis | 229/117.08 |
| 5,732,849 | A | 3/1998 | Brooks | |
| 5,850,911 | A * | 12/1998 | Pakzad | 206/217 |
| 5,971,139 | A | 10/1999 | Bradley | |
| 6,109,580 | A | 8/2000 | Stern et al. | |

(Continued)

FOREIGN PATENT DOCUMENTS

GB 2 053 853 A 2/1981

OTHER PUBLICATIONS

"Breakfast Tray with Folding Legs," NexTag Comparison Shopping, printed Oct. 30, 2008.

(Continued)

*Primary Examiner* — Jose V Chen
(74) *Attorney, Agent, or Firm* — Miller Patent Services; Jerry A. Miller

(57) ABSTRACT

A food and beverage tray in various implementations has one or more of drink bands, retractable legs and/or a collapsing tray assembly. This abstract is not to be considered limiting, since other embodiments may deviate from the features described in this abstract.

33 Claims, 34 Drawing Sheets

U.S. PATENT DOCUMENTS

| | | | | |
|---|---|---|---|---|
| 6,152,417 | A * | 11/2000 | Randall | 108/43 |
| 6,264,026 | B1 | 7/2001 | Bradley | |
| 6,478,371 | B1 | 11/2002 | Clarke | |
| 6,591,831 | B2 * | 7/2003 | Reynolds | 108/26 |
| 6,675,721 | B2 | 1/2004 | Zeiders | |
| 6,732,990 | B2 | 5/2004 | Hudson | |
| 6,997,111 | B2 * | 2/2006 | Giegerich | 108/25 |
| 7,004,377 | B2 | 2/2006 | Metcalf | |
| 7,007,838 | B1 | 3/2006 | Bostick, II | |
| 7,025,199 | B1 | 4/2006 | Lim | |
| 7,044,359 | B1 | 5/2006 | Cohen | |
| D527,953 | S | 9/2006 | Le Gal | |
| 7,185,758 | B2 | 3/2007 | Cuomo | |
| 7,232,055 | B1 | 6/2007 | Lim | |
| D547,567 | S | 7/2007 | Reiner | |
| 7,243,785 | B2 | 7/2007 | Cuomo | |
| 7,267,224 | B2 | 9/2007 | Cuomo | |
| 7,267,400 | B2 | 9/2007 | Cutshall et al. | |
| 7,344,056 | B2 | 3/2008 | Shelmon et al. | |
| D567,670 | S * | 4/2008 | Say Ulin | D9/753 |
| 7,360,666 | B1 | 4/2008 | Primel et al. | |
| 2004/0112259 | A1 | 6/2004 | Zeiders | |

OTHER PUBLICATIONS

"Breakfast & Bed Trays," TV Tray Source, copyright 2007-2009.
"Butler Trays,". Simply Tray Tables, copyright 2002-2008.
"TV Trays & Snack Tables," Simply Tray Tables, 2002-2008.

* cited by examiner

FOOD AND BEVERAGE TRAY

CROSS REFERENCE TO RELATED DOCUMENTS

This application is related to and claims priority benefit of Provisional Patent Application No. 61/200,605, filed Dec. 2, 2008, which is hereby incorporated by reference in its entirety.

COPYRIGHT AND TRADEMARK NOTICE

A portion of the disclosure of this patent document contains material which is subject to copyright protection. The copyright owner has no objection to the facsimile reproduction of the patent document or the patent disclosure, as it appears in the Patent and Trademark Office patent file or records, but otherwise reserves all copyright rights whatsoever. Trademarks are the property of their respective owners.

BACKGROUND

Cardboard trays are most commonly used by concessionaires at sporting events and the like. Such trays, on an individual basis, are inexpensive but cumulatively are costly and environmentally unfriendly resulting in large quantities of trash that is often left for stadium maintenance personnel to clean up.

BRIEF DESCRIPTION OF THE DRAWINGS

Certain illustrative embodiments illustrating organization and method of operation, together with objects and advantages may be best understood by reference detailed description that follows taken in conjunction with the accompanying drawings in which.

DETAILED DESCRIPTION

Figure 1:
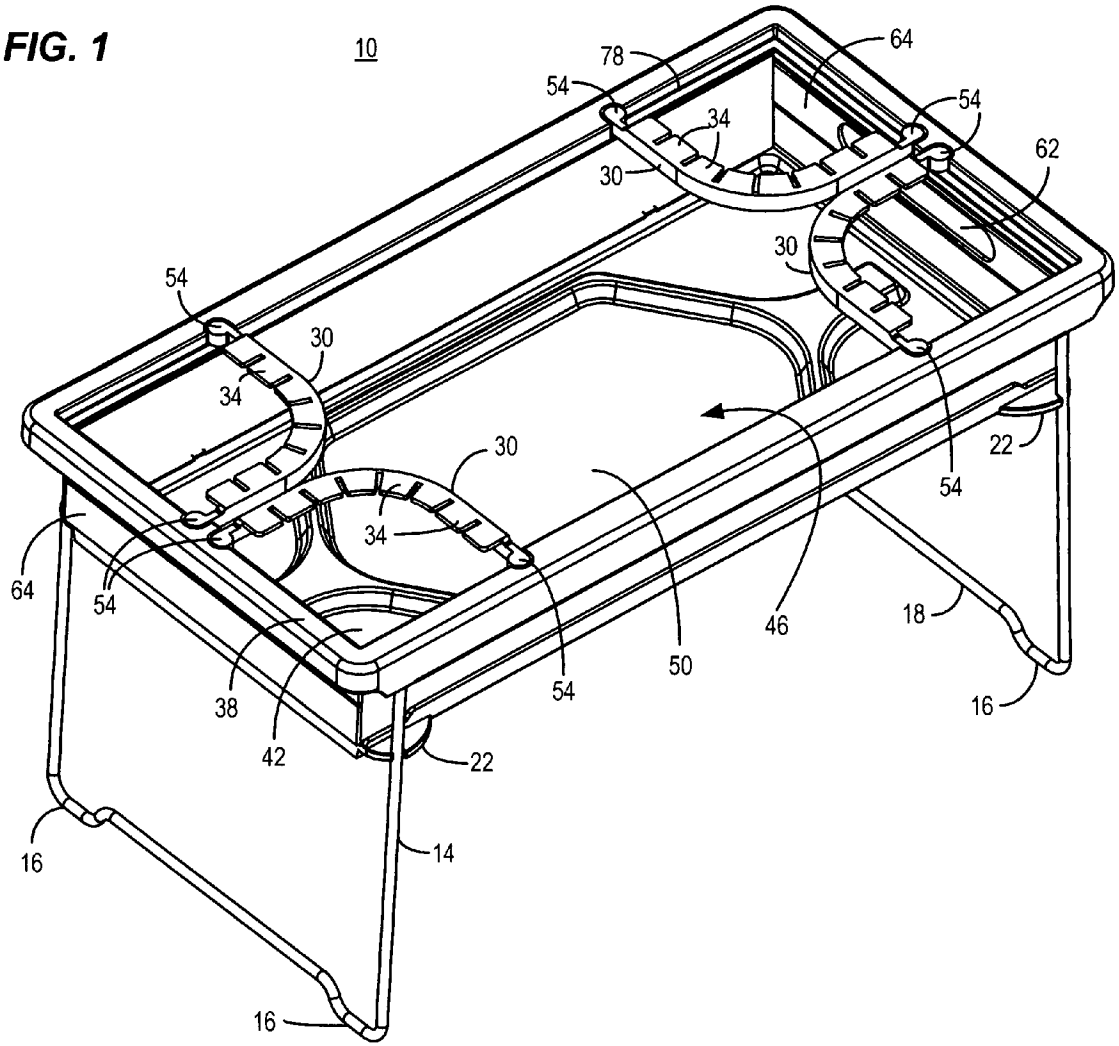
FIG. 1 is a top isometric view of an example food and beverage tray consistent with certain embodiments of the present invention.

While this invention is susceptible of embodiment in many different forms, there is shown in the drawings and will herein be described in detail specific embodiments, with the understanding that the present disclosure of such embodiments is to be considered as an example of the principles and not intended to limit the invention to the specific embodiments shown and described. In the description below, like reference numerals are used to describe the same, similar or corresponding parts in the several views of the drawings.

The terms "a" or "an", as used herein, are defined as one or more than one. The term "plurality", as used herein, is defined as two or more than two. The term "another", as used herein, is defined as at least a second or more. The terms "including" and/or "having", as used herein, are defined as comprising (i.e., open language). The term "coupled", as used herein, is defined as connected, although not necessarily directly, and not necessarily mechanically.

Reference throughout this document to "one embodiment", "certain embodiments", "an embodiment", "an example", "an implementation" or similar terms means that a particular feature, structure, or characteristic described in connection with the embodiment, example or implementation is included in at least one embodiment, example or implementation of the present invention. Thus, the appearances of such phrases or in various places throughout this specification are not necessarily all referring to the same embodiment, example or implementation. Furthermore, the particular features, structures, or characteristics may be combined in any suitable manner in one or more embodiments, examples or implementations without limitation.

The term "or" as used herein is to be interpreted as an inclusive or meaning any one or any combination. Therefore, "A, B or C" means "any of the following: A; B; C; A and B; A and C; B and C; A, B and C". An exception to this definition will occur only when a combination of elements, functions, steps or acts are in some way inherently mutually exclusive.

Turning now to FIG. 1, an example reusable food and beverage tray 10 consistent with certain embodiments is depicted from above in perspective view. The tray 10 includes a pair of folding retractable legs 14 and 18 are provided at each end of the tray assembly. The legs themselves are preferably made of a non-corrosive metal bent basically into a somewhat U-shaped configuration with the corners 16 of the U dipping downward before extending toward the middle of the bottom, and the top of the U having hooks that engage a pin as will be described later. The central area of the bottom of the U can be provided with a foam, plastic or other suitable coating to facilitate gripping. Moreover, the downward dips, being at the lowest point when the legs are deployed, may get soiled. If so, the central area at the bottom of the U will remain clean for handling. In one embodiment, the legs are made of 3/16 inch diameter steel rod bent from a 15 inch rod and clear coated zinc finished. The top of the legs bend inward to fit within a slot formed using a leg retaining member (as will be described later) that permits the legs 14 and 18 to be rotated outward and then slid toward the middle so that the legs fold up into the body of the tray when not in use.

When in use, the legs 14 and 18 are retained in the position shown by two pairs of retainers 22 (on each side—two shown) that hold the legs in a tray supporting configuration. As used herein, 14 and 18 are used interchangeably except where there is some distinction being drawn in the text.

The tray 10 itself is preferably made of a plastic such as polypropylene with an overall rectangular shape which incorporates a configurable beverage holding mechanism at each corner. The tray 10 is made of a rim portion and a floor portion that are attached together by screws or sonic welding or other suitable attachment mechanism, the rim and floor portions having a texture such as SPI-SPE Mold finish #3 applied to the cavity side in one implementation. In the open position shown, tray 10 resembles an open box structure with walls and a bottom. In one implementation, the open box is approximately five inches in height, but dimensions given should not be considered limiting. As will be seen later, this open box structure can collapse in order to reduce the height for easy storage. In one implementation example, the box structure collapses to slightly more than about one inche in height. The rectangular shape can be, for example about 17 inches by about 8.9 inches, but other shapes and dimensions are also suitable. It is preferred that the shape be such that it fits reasonably within the confines of one seat at a typical stadium or arena so as not to intrude on adjacent seats when fully deployed. Additionally, the trays are desirably stackable so that multiple trays can be stowed or packaged in minimal space. It will be appreciated that all dimensions given herein are intended as examples and not to be considered limiting in any way.

The beverage holding mechanism incorporates a strap or band such as 30 at each corner. The band 30 is made of a flexible rubber material which has a number of fingers 34 along the edge facing each corner. These are referred to as "drink bands" 30 herein and are preferably made of a firm but flexible material such as TPE rubber (shore A 70) so as to provide for the flexing of the fingers and firm retention of beverage cups of various sizes. These drink bands 30 can be extended as shown to carry as many as four cups containing beverages with the fingers 34 flexing to hold cups of varying sizes in place. Additionally, the beverage cup is held in place at each corner by the upper wall 38 of the tray assembly at the corner providing two point contact therewith at points dependent upon the diameter of the cup (assuming an approximately round cup). Additionally, further stability of the cup when used for carrying from, for example, a concessionaire to a stadium seat, is provided by recesses 42 at the lower surface of the tray 10 at each corner thereof. Such recesses are molded into the plastic lower surface or floor 46 of the tray 10.

If any of the cup holders is not in use, the usable size of the tray for other items can be increased by collapsing the drink bands 30 into the inner wall of the tray 10. This is simply accomplished by pushing the drink band 30 toward its corner. This causes the band to flex inward toward the corner, and the ends of the band 54 which are circular and are retained in a circular hole or recess in the tray 10 until the band collapses into a mating trough or recess along the edge of the upper wall 38. This trough is shown most clearly in this view at 78.

A central recess 50 may also be provided to help retain food items such as hot-dogs, hamburgers, popcorn or other stadium or arena food in place. The recesses can help to contain spills. Additionally, a slot 62 can be provided in the end walls 64 of the tray 10 to serve as a carrying handle to aid in carrying the tray when filled with food. The tray 10 is also retractable vertically to make the tray more compact for stowing away or carrying when not filled with food and drink, as will be explained later. The central recess area provides a convenient surface, either on the interior side or the exterior side for application of a decal such as that of a team or college logo, flag, or other decorative image.

Figure 2:
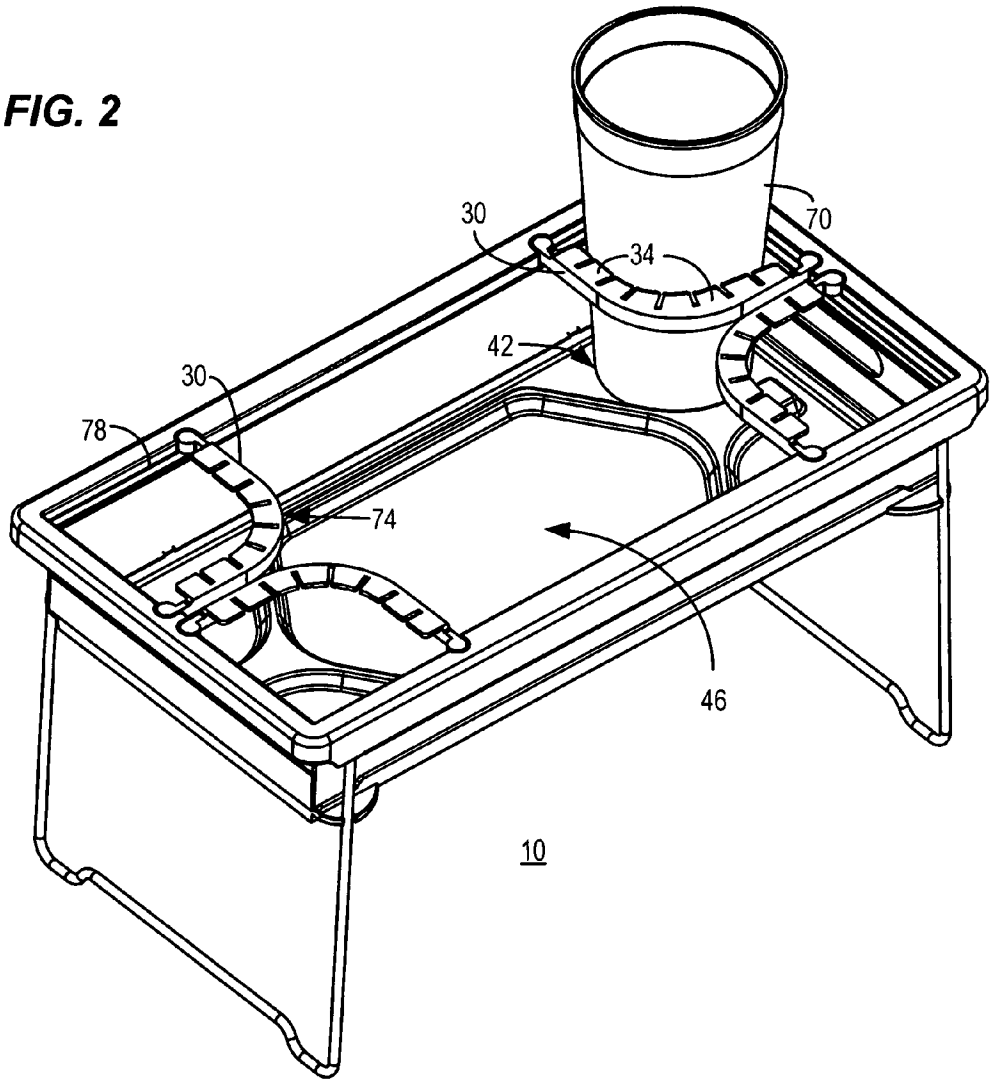
FIG. 2 is a top isometric view of an example food and beverage tray showing operation of one of the cup holders consistent with certain embodiments of the present invention.

Referring now to FIG. 2, the action of one of the drink bands 30 is shown holding a cup 70. The lower portion of cup 70 is secured from sliding by the recess 42 at the floor 46 of tray 10. Depending on the diameter of the cup 70, the fingers 34 of drink band 30 may remain fully extended as shown or may bend downward to accommodate various cup sizes. Eight such fingers 34 are shown, but other configurations are possible and contemplated. Unused drink bands 30 may be collapsed into the corner of the tray by simply pressing the drink band toward the corner as illustrated by arrow 70. When collapsed into the corner, the drink band 30's fingers rest on a ridge 78 provided to allow the drink band 30 to maximally get out of the way for access to the remainder of the tray for carrying other items.

Figure 5:
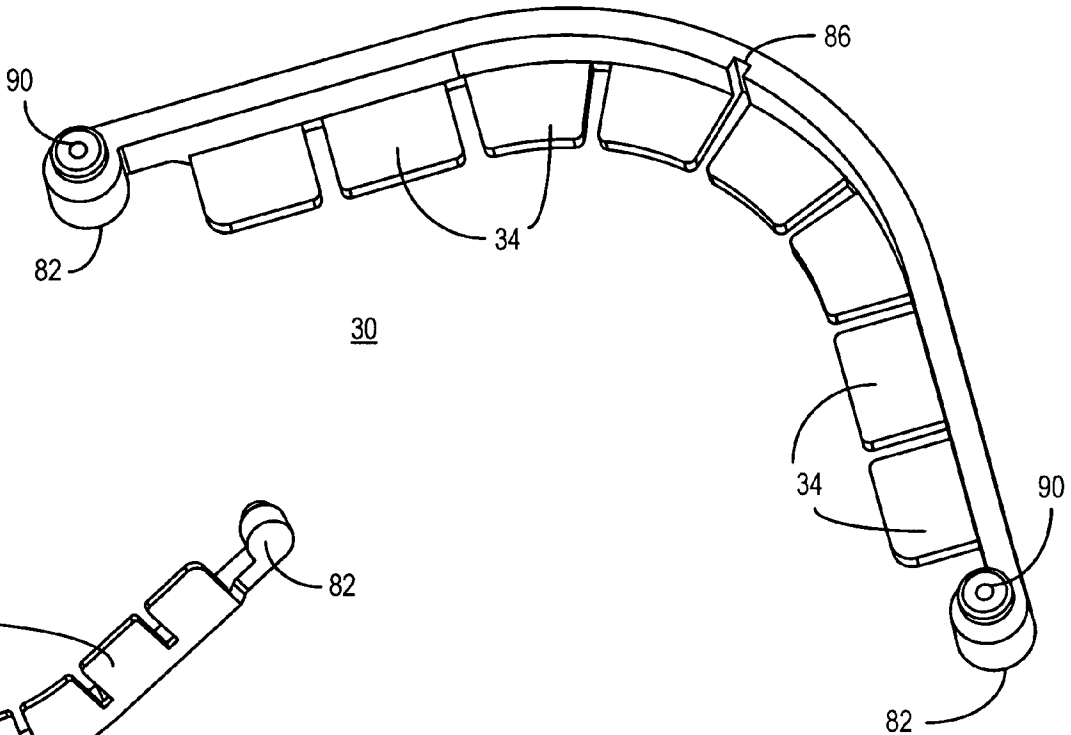
FIGS. 3-8 are various views of a example drink bands consistent with certain embodiments of the present invention.
Figure 3:
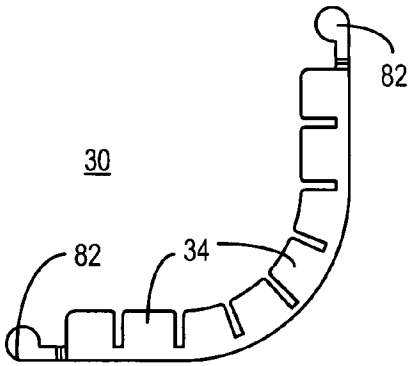
Figure 4:
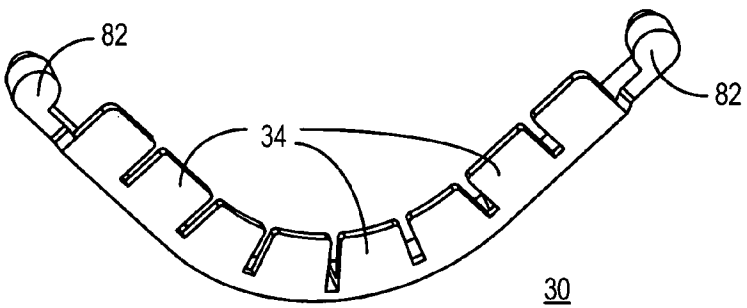

The drink bands themselves are shown in FIGS. 3-8 in various views. FIG. 3 is a top view showing the eight fingers 34 and the top of the rotating end members 82. FIGS. 4-5 show other views of the drink bands. In FIG. 5, the fingers 34 are also shown along with a relief recess 86 that permits the drink bands to be readily bent in the opposite direction than that shown so that the drink band will closely conform to the corner of the tray when the drink band is collapsed. The drink band 30 also incorporates, in this implementation, a molded in button 90 at each of the rotating end members. These buttons 90 can be somewhat mushroom shaped or otherwise shaped to act as a male connection portion so as to snap into engagement with a mating female aperture or recess in the tray rim. Once engaged, they are preferably removable completely if desired, or may be permanently left in place and rotated during the action of collapsing the drink bands 30 into the corners of the tray as desired by the user. Each of these figures depict the drink band in a bent position much as they would appear in active use in the tray assembly.

The drink bands 30, in one implementation are approximately 6.5 inches in length from center to center of buttons 90. The band 30 is approximately 0.25 inches deep (side to side) and approximately 0.40 inches tall (top to bottom). The fingers extend outward from the band by approximately 0.25 inches and are approximately 0.05 inches thick with eight such fingers provided. The slot or slots 86 may be approximately 0.25 inches deep to permit easy flexing of the band toward the stowed position. These dimensions are illustrative and permit holding a variety of cup sizes. However, those skilled in the art will appreciate that other specific configurations, materials and dimensions are also possible upon consideration of the present teachings.

Figure 7:
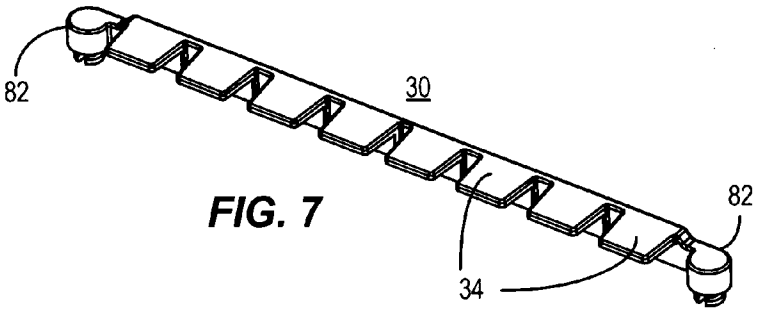
Figure 8:
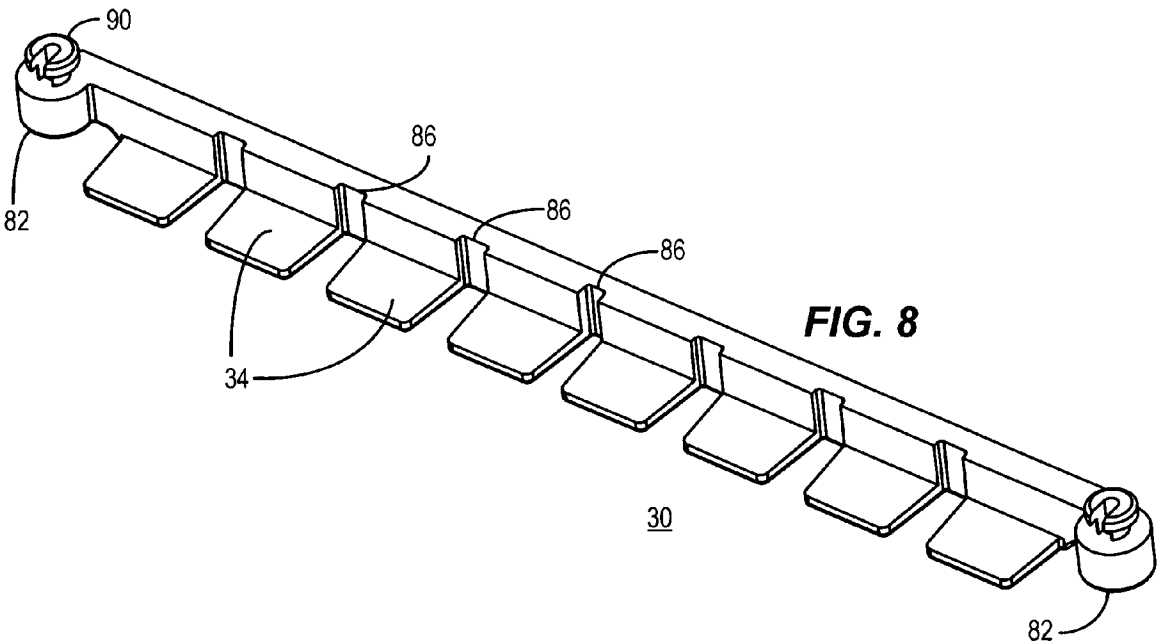
Figure 6:
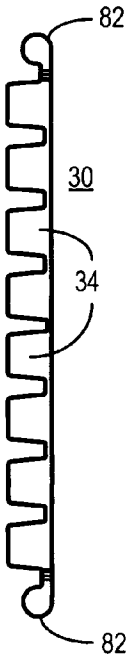

FIGS. 6-8 depict the drink bands 30 as molded in several views. FIG. 6 is a top view and FIG. 7 is a top perspective view. FIG. 8 in particular depicts that multiple relief recesses 86 may be provided to permit the band to readily flex toward the corner when flexed into the collapsed or stowed position. Additionally, a variation of buttons 90 is depicted wherein the buttons incorporate a relief slot to facilitate easy compression for assembly into the mating female aperture or recess of the tray rim.

Figure 9:
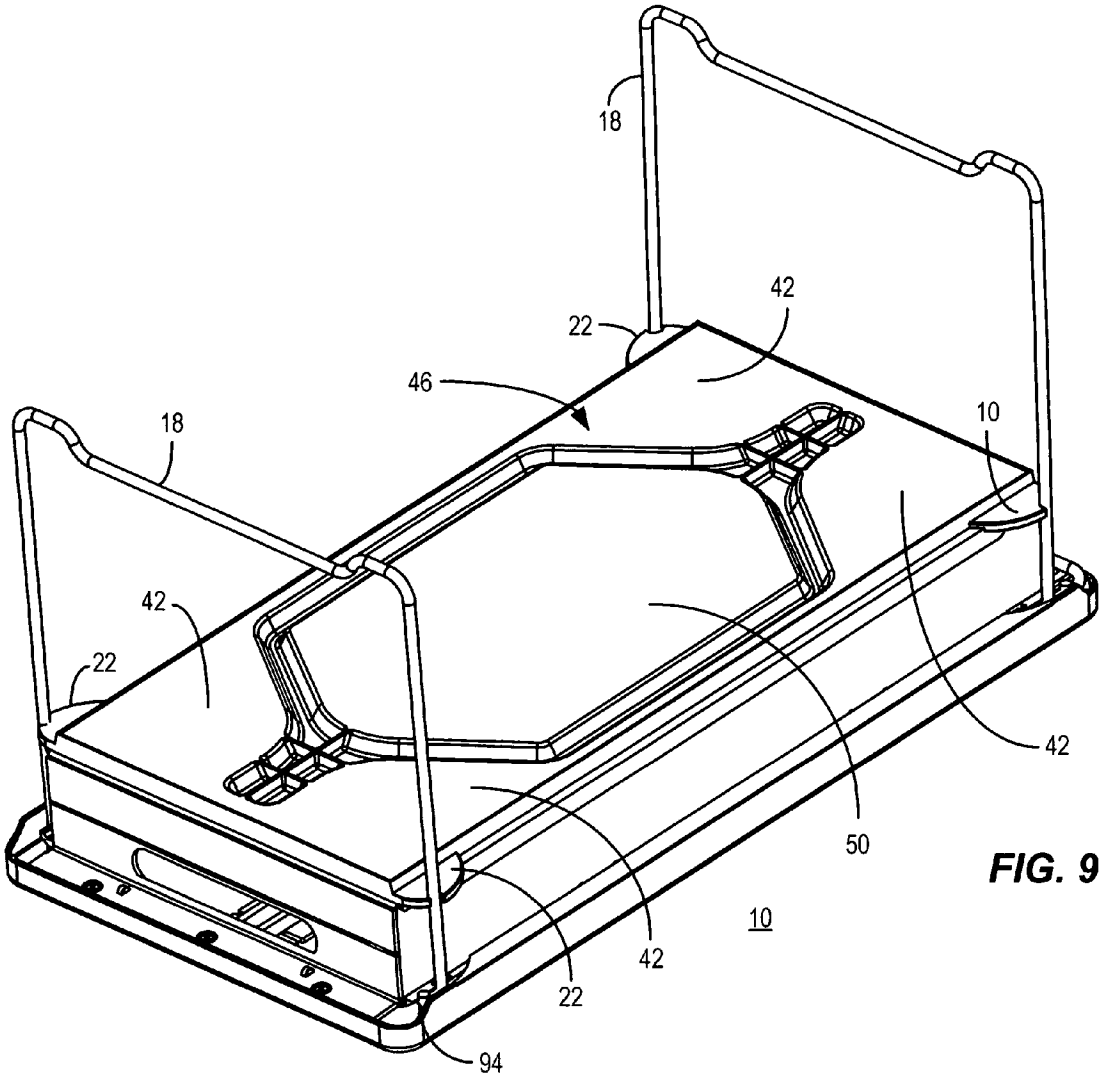
FIG. 9 is a bottom isometric view of an example food and beverage tray consistent with certain embodiments of the present invention with the legs deployed.

FIG. 9 shows the tray 10 upside down with the legs 14 and 18 in the extended downward position (upside down) and locked into place by elements 22. As is also seen in this illustration the four ends of each of the U shaped legs include a hook-like bend with the end shown at 94 which wraps around a metal pin to further captivate the legs. In this illustration, the lower surface of floor 46 faces upward and the lower surfaces of recesses 42 and 50 extend upward.

Figure 10:
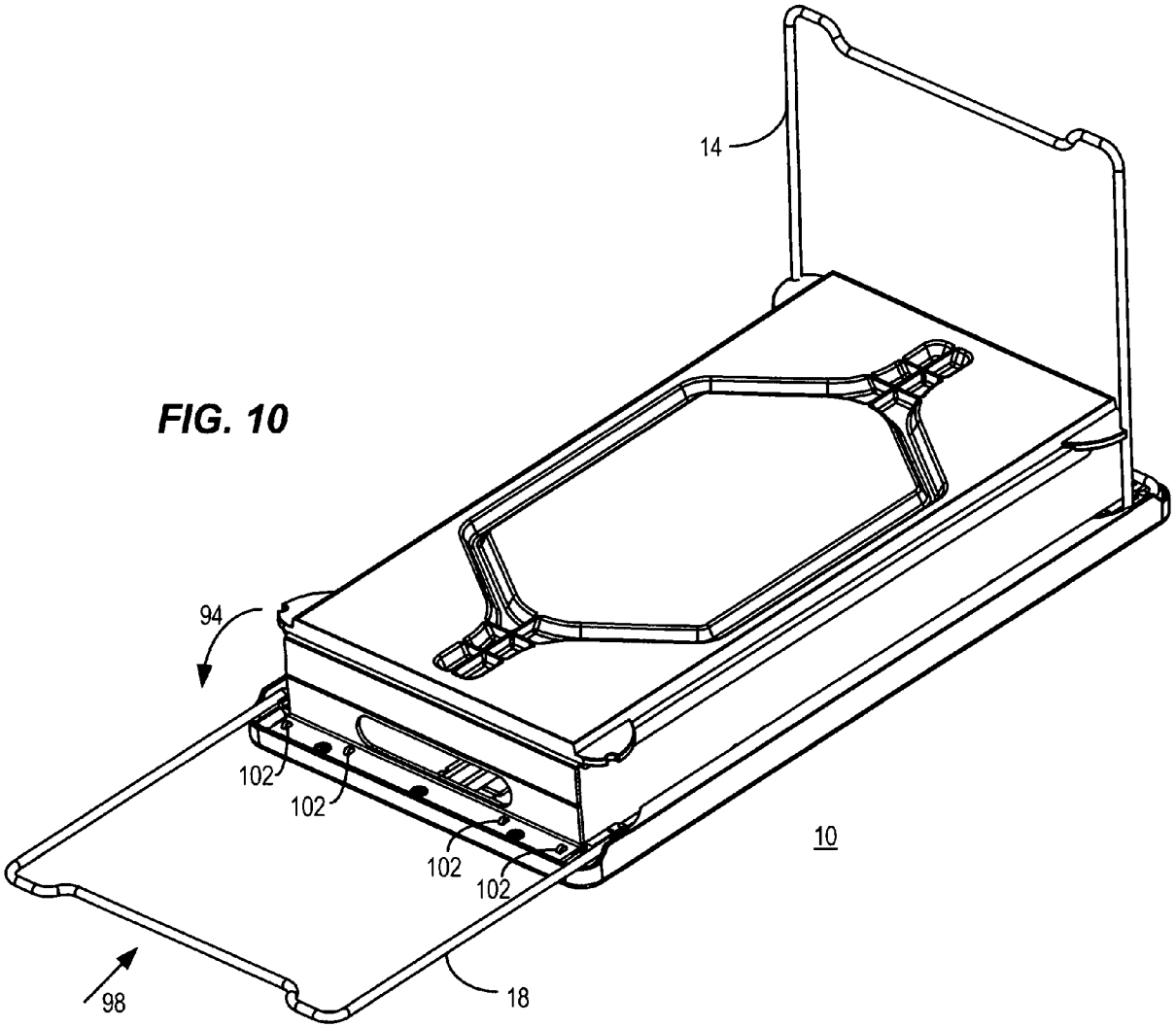
FIG. 10 is a bottom isometric view of an example food and beverage tray depicting the process for closing deployed legs in a manner consistent with certain embodiments of the present invention.
Figure 11:
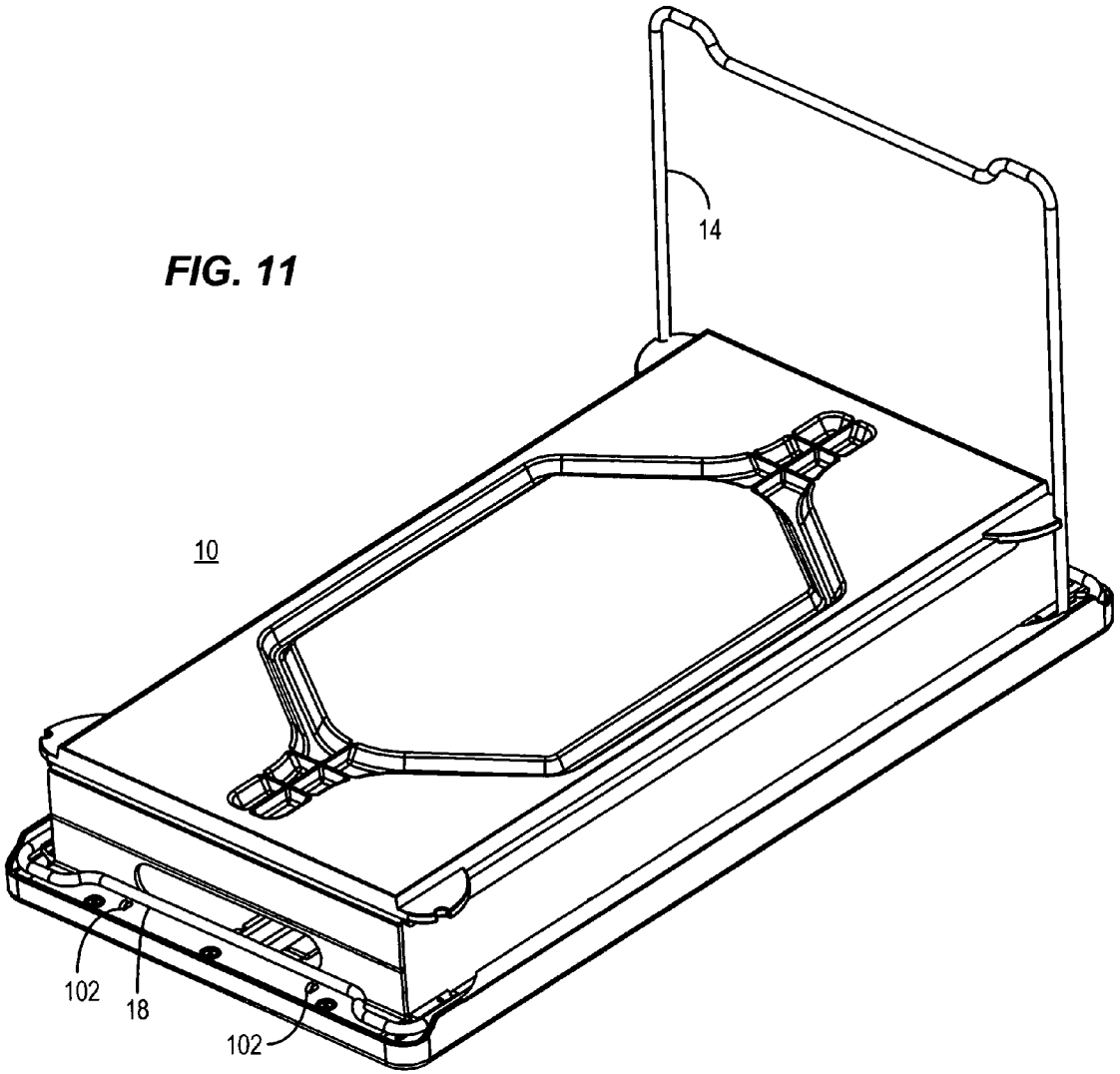
FIG. 11 is a bottom isometric view of an example food and beverage tray depicting one set of legs fully stowed in a manner consistent with certain embodiments of the present invention.

The legs 14 and 18 can be folded up and stowed away by unsnapping the legs from elements 22 by rotating them outward in the direction of arrow 94 in the case of leg 18 (and the opposite direction in the case of leg 14) and extending the legs outward until parallel with the plane of the tray rim as shown in FIG. 10. Once the leg is extended outward as shown, it can be slid into place by sliding in the direction of arrow 98 until it snaps into the stowed position over retaining protuberances 102 provided on the lower surface of the tray's rim. The stowed leg 18 is depicted in FIG. 11 locked in place by protuberances 102. Leg 14 can be similarly positioned for storage and ease of carrying. The legs are deployed by movements in the opposite direction as those shown for stowing the legs.

Figure 12:
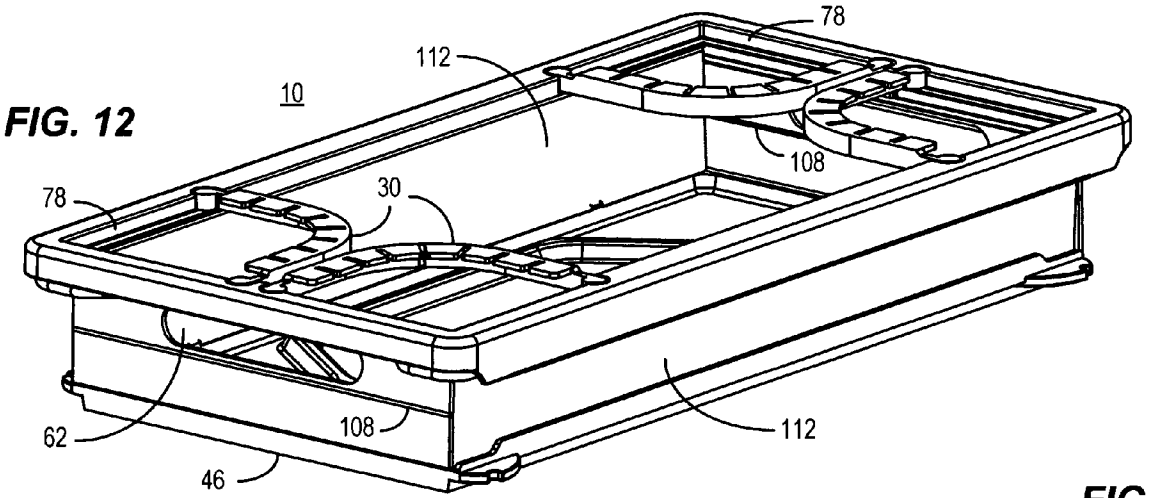
FIGS. 12-14 are various views of an example food and beverage tray with legs deployed, but with the tray in its expanded state in a manner consistent with certain embodiments of the present invention.
Figure 13:
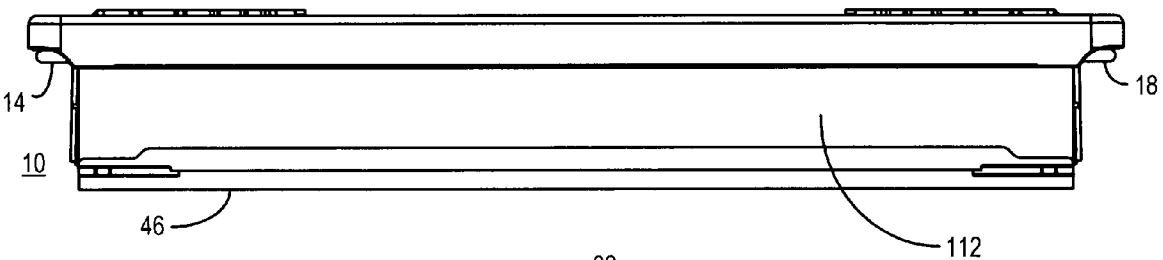
Figure 14:
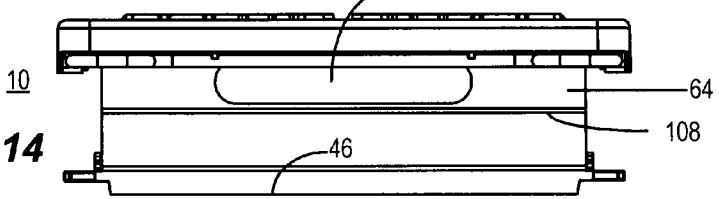

FIGS. 12-14 depict the tray 10 in the open position with legs folded from various views. FIG. 12 shows the tray in perspective with the drink bands 30 and the carrying handle 62 readily perceived. Also shown is the end panel or wall 64 is made up of upper and lower parts as shown. It can be readily noted that the end panel 64 is provided with multiple hinges such as living hinges molded into the plastic or other hinge mechanism 108. The opposite end wall 64 contains a similar hinging mechanism 108 that is partially visible in this view. The tray 10 can be compacted vertically by flexing the end wall 64 at the hinge 108. The side walls 112 are only attached by a hinging mechanism such as a living hinge molded at the upper surface and are first rotated inward and the end walls 64 fold accordion style over the side walls 112 so as to collapse the tray 10 as depicted in FIGS. 15-18. Hence, the end walls 64 are hinged at both the central area and near the top so as to fold inward when the structure is collapsed to reduce the height of the box-like tray structure.

Figure 15:
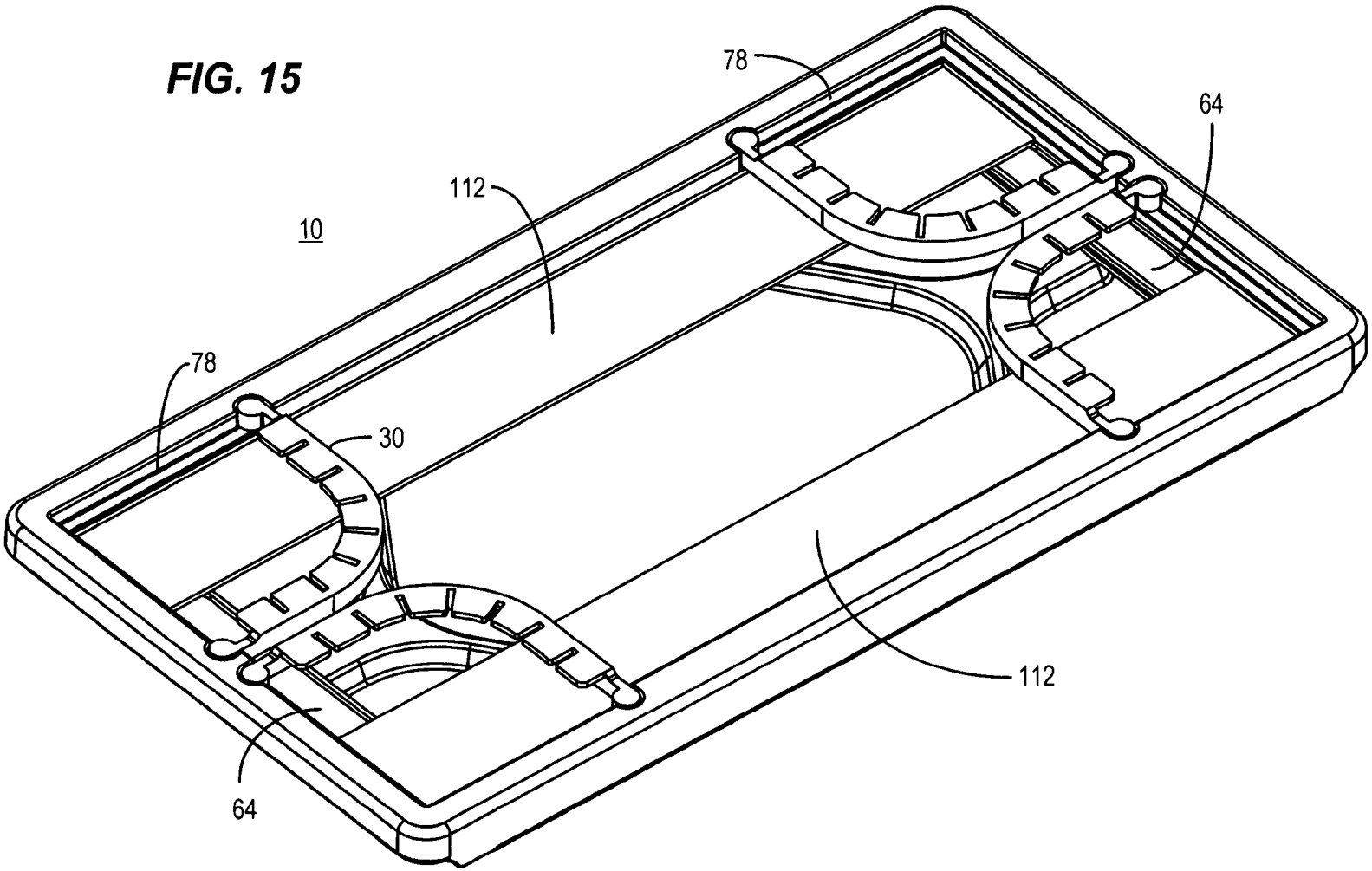
FIGS. 15-18 are various views of an example food and beverage tray with the tray height collapsed in a manner consistent with certain embodiments of the present invention.
Figure 16:
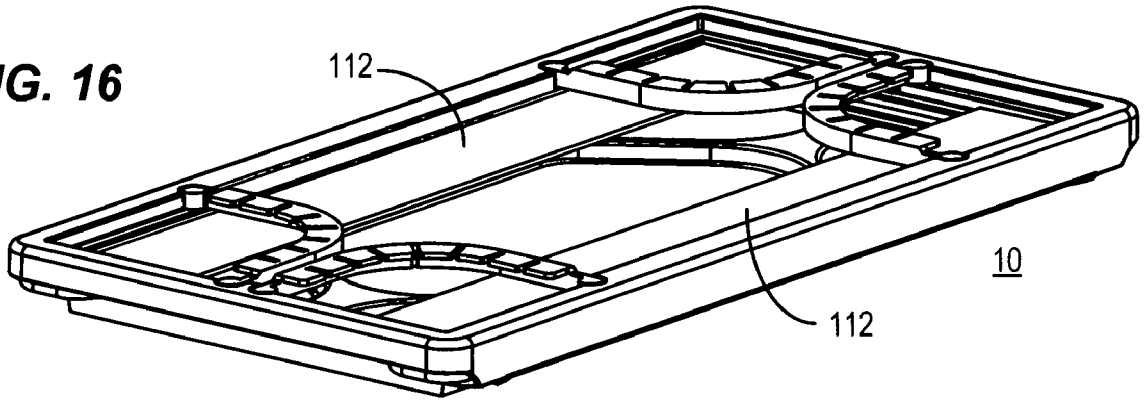
Figure 17:
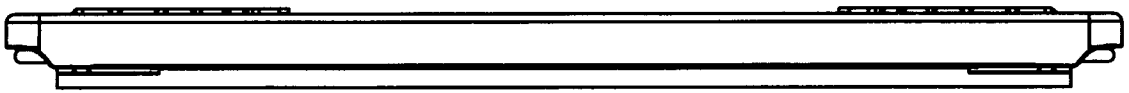
Figure 18:
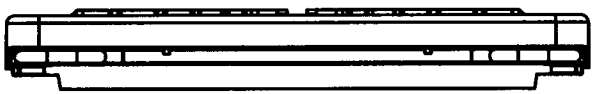

The various elements described in connection with FIG. 12 are variously also shown in the open position in FIGS. 13-14. Referring to FIG. 15, tray 10 is depicted in its compact collapsed (closed) arrangement with the side walls 112 and end walls 64 shown in their folded position. The drink bands 30 can either be stowed in the corners or retained in their operative position as shown. FIGS. 16-18 show the tray in the closed position from various viewpoints.

Figure 19:
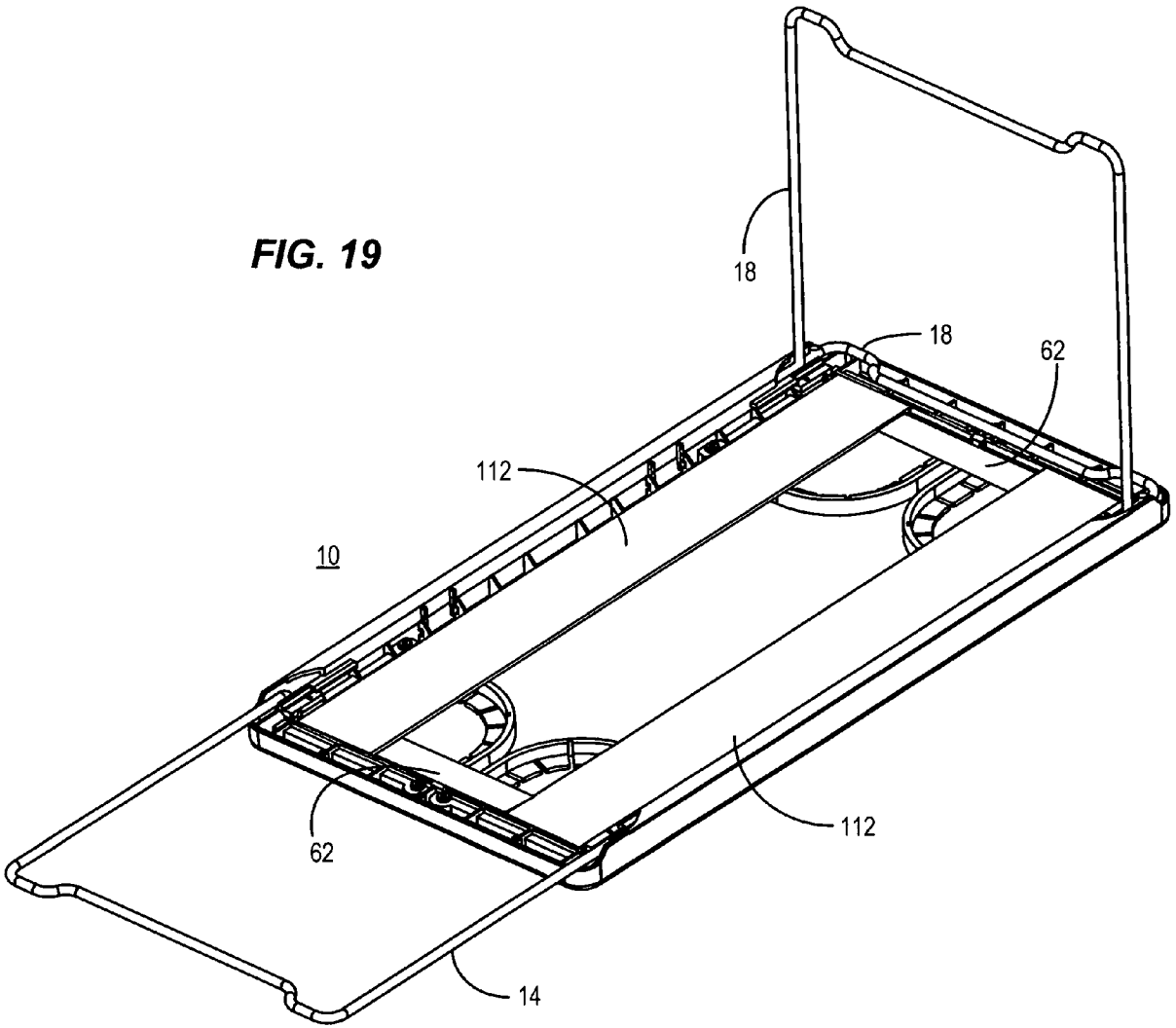
FIG. 19 is an isometric view of an example food and beverage tray with legs in various states of deployment while the tray height is collapsed in a manner consistent with certain embodiments of the present invention.

FIG. 19 depicts that the legs can also be opened or retracted when the tray is in the closed compact configuration. In this illustration, legs 14 are shown extended as in either the opening or closing process, while legs 18 are shown both open and closed (an impossible simultaneous scenario, but useful for illustrative purposes). The side walls 112 and the end walls 62 are shown collapsed in the closed compact configuration.

Figure 20:
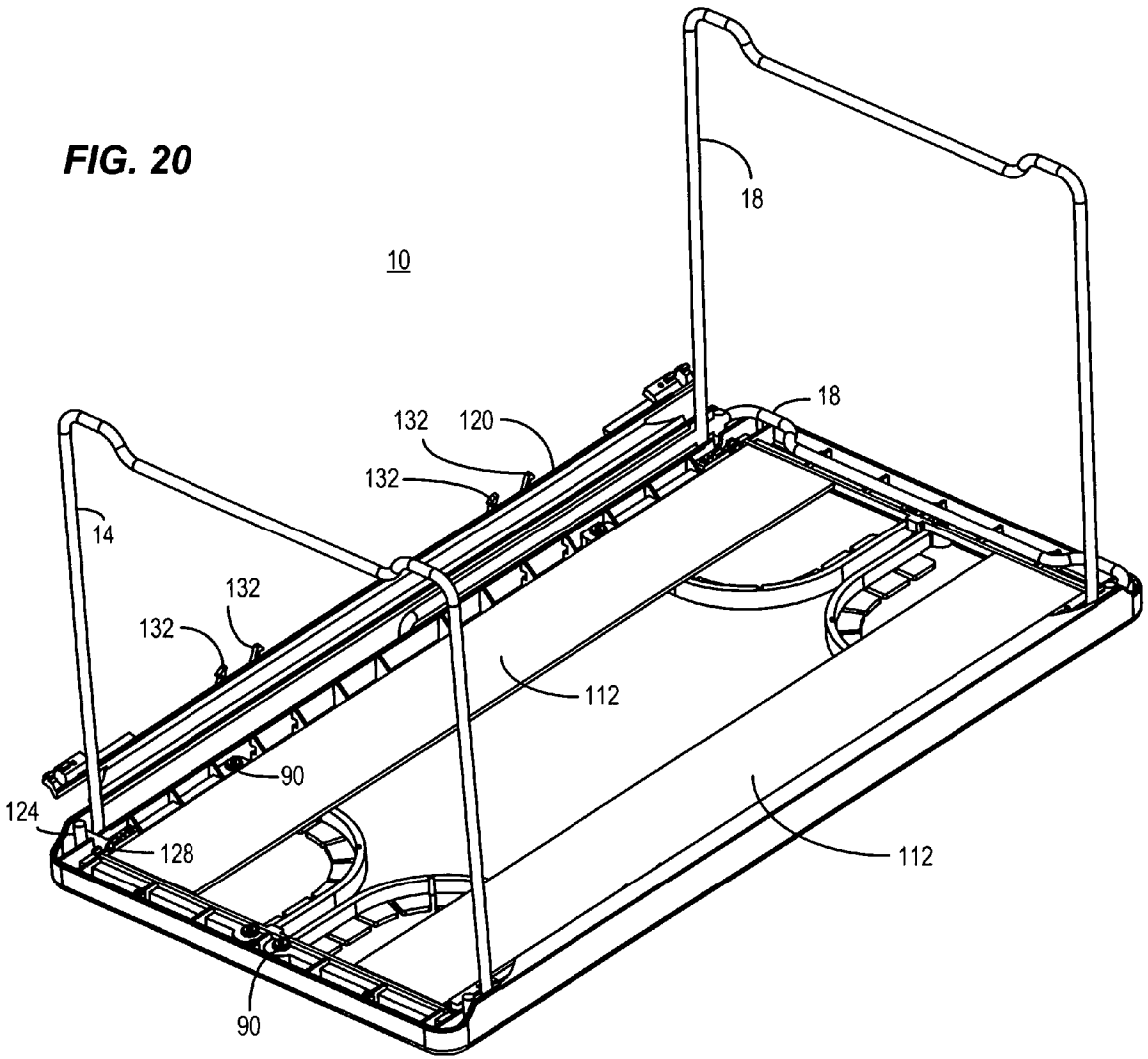
FIG. 20 is an isometric view of an example food and beverage tray with legs deployed and un-deployed depicting one of the leg compartments open while the tray height is collapsed in a manner consistent with certain embodiments of the present invention.

FIG. 20 depicts the compacted tray with one of the leg retaining members 120 shown in the unassembled position. In this position, the hooked ends 124 of the leg 14 are visible. Also visible are the buttons 90 in their assembled position from below the tray's rim. The hooked ends 124 hook around retaining pins 128 which are locked in place by the retaining members 120. Retaining members 120 can be arranged in many ways including use of flexible molded-in latches 132 that mate with an appropriate latch receiving structure on the tray. In this illustration, again, legs 18 are shown both in the open and closed position. End walls 64 are not depicted in this illustration in order to illustrate the structure beneath the end walls 64 when the tray 10 is closed. When retaining member 20 is closed, it produces a chamber in which the legs 14 and 18 slide to retract and are then held in place by protuberances 102. When the legs are pulled outward as the first step of deploying the legs, the hook-like ends 124 encounter pins 128 that limit their outward movement and provide a pivot point for rotating the legs into the locked position engaging locking elements 22.

Figure 21:
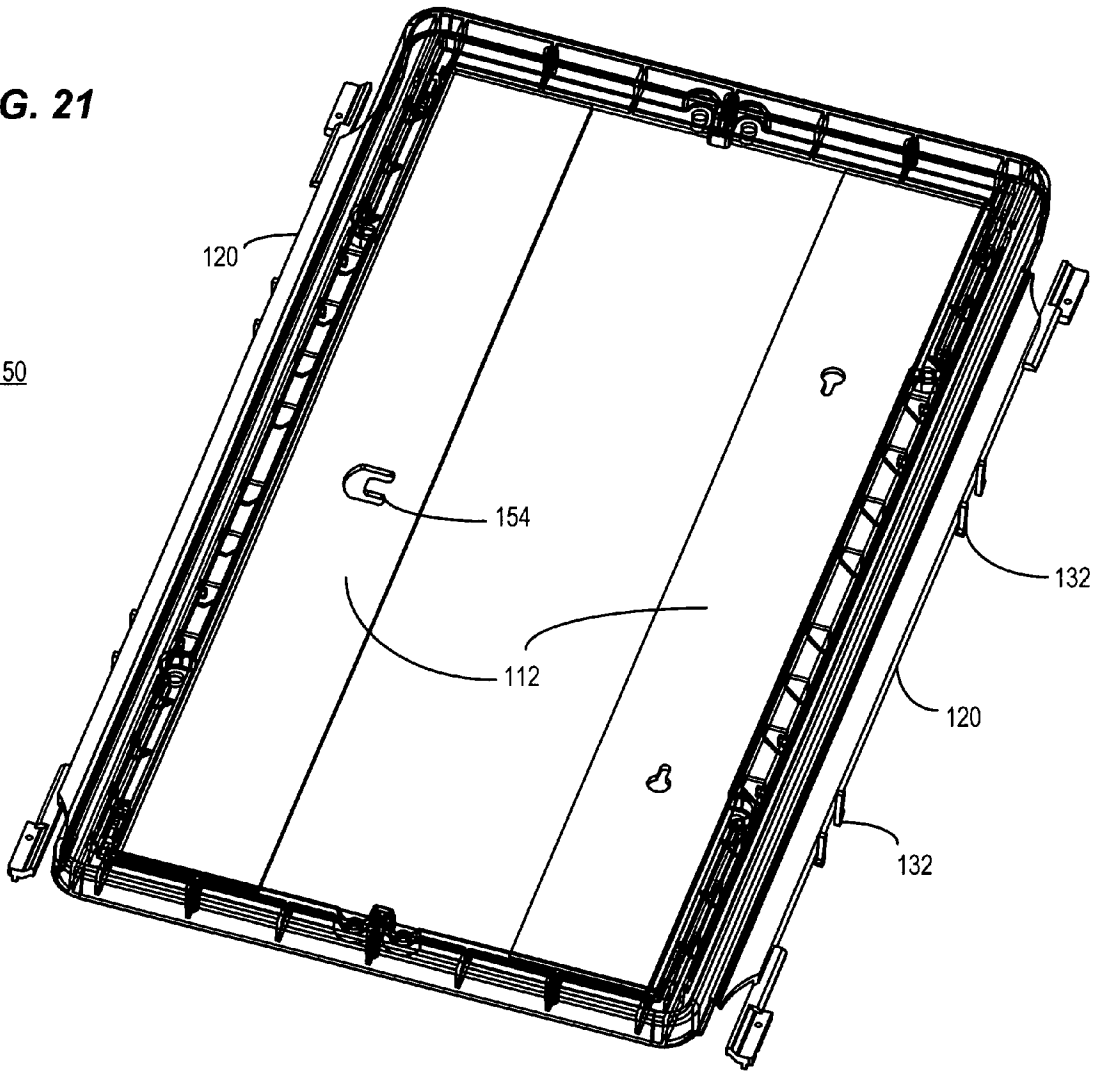
FIG. 21 is an isometric view of an example food and beverage tray rim element consistent with certain embodiments of the present invention.
Figure 22:
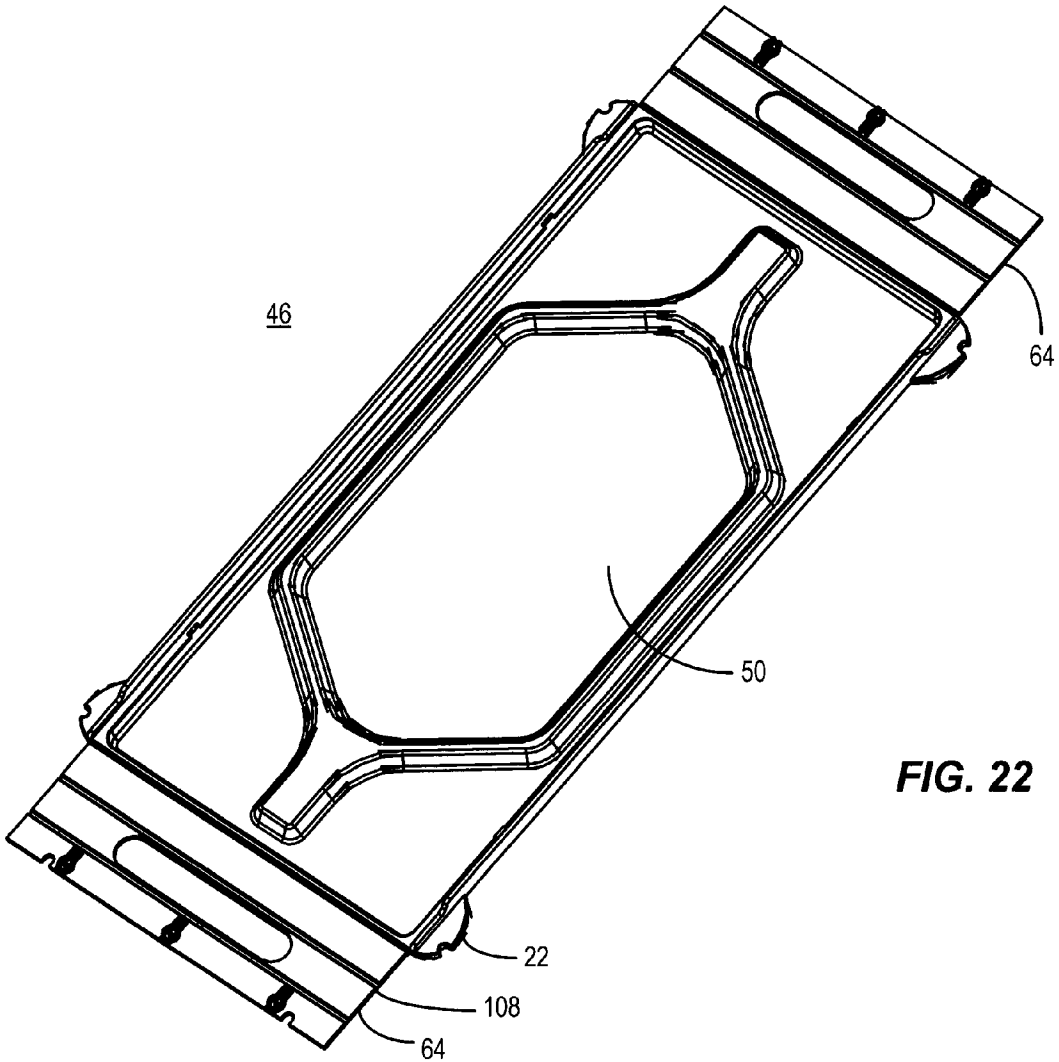
FIG. 22 is an isometric view of an example food and beverage tray floor element consistent with certain embodiments of the present invention.
Figure 23:
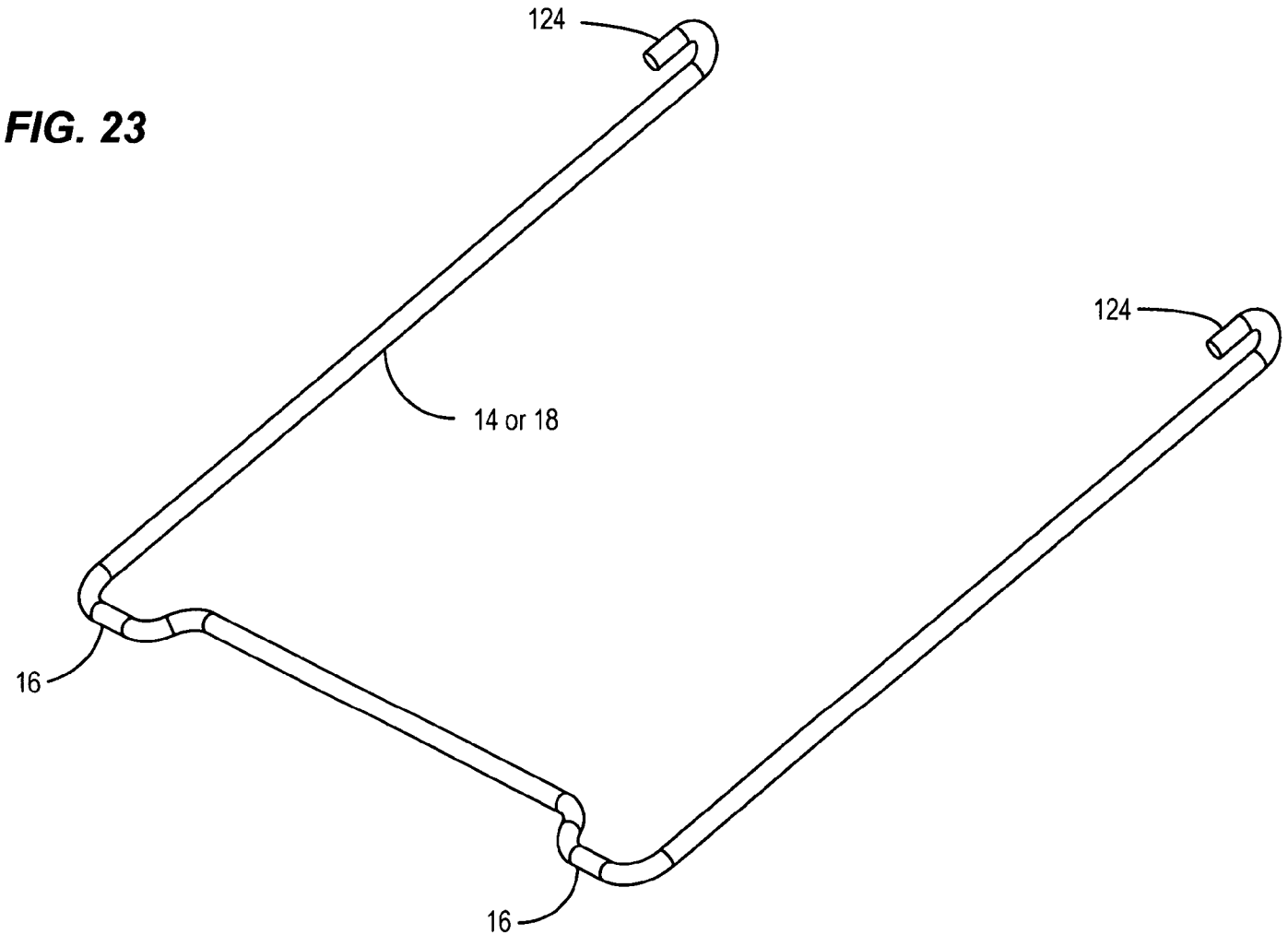
FIG. 23 is a view of an example food and beverage tray leg element consistent with certain embodiments of the present invention.
Figure 24:
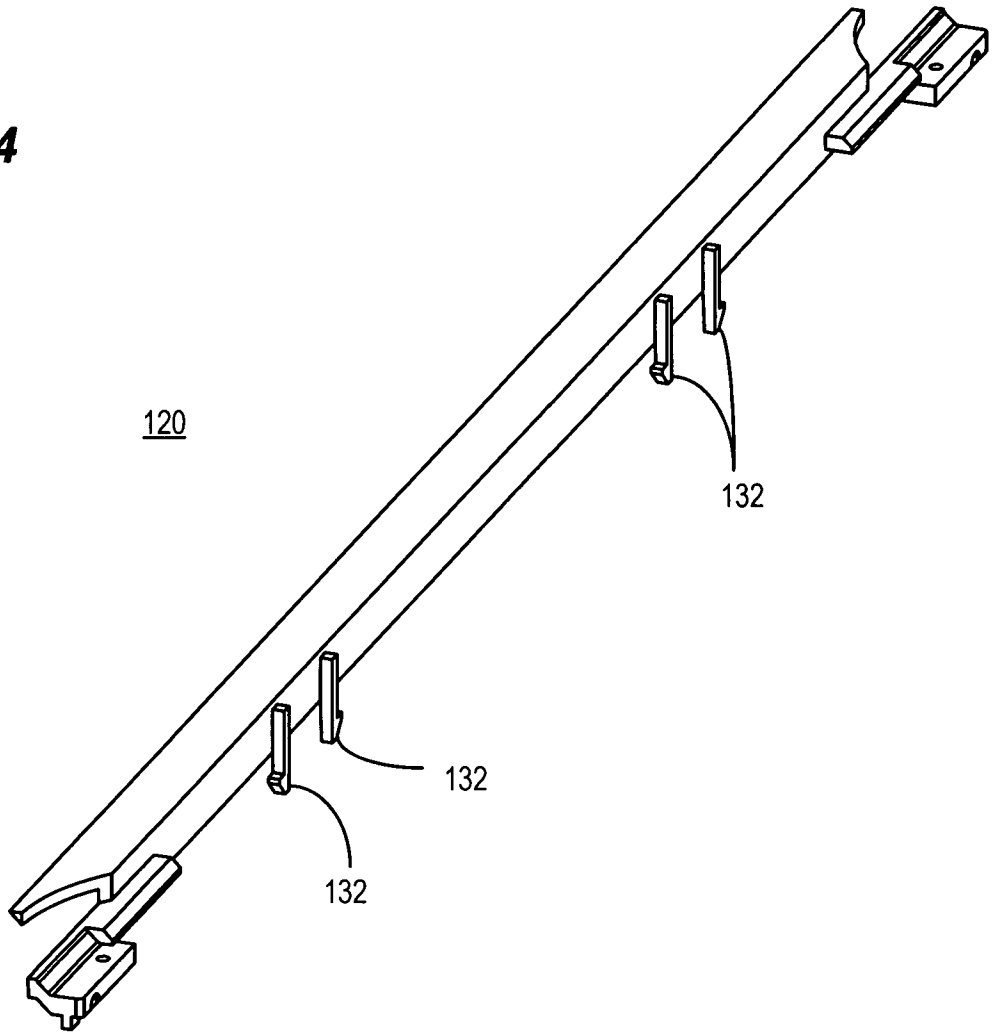
FIG. 24 is an isometric view of an example food and beverage tray's leg retaining member in isolation consistent with certain embodiments of the present invention.
Figure 25:
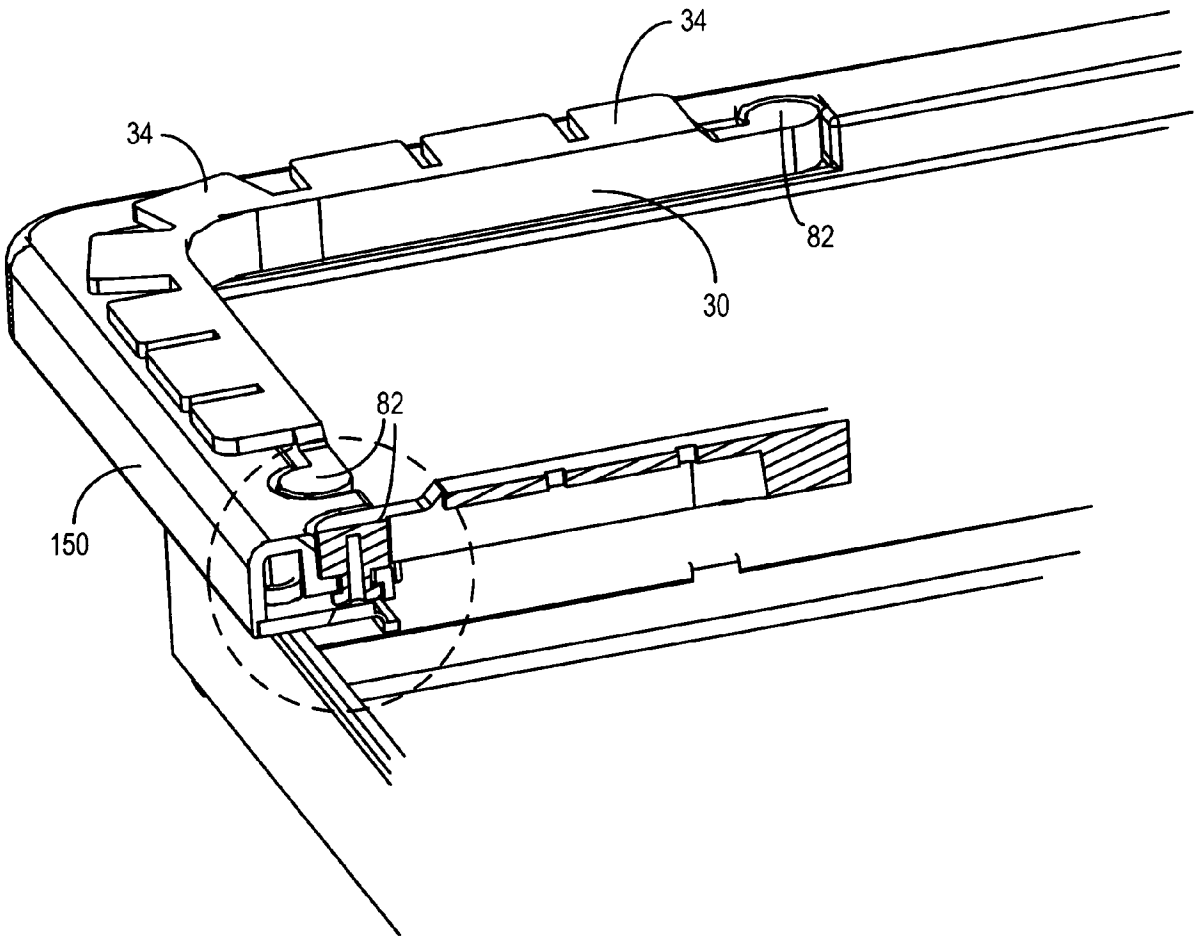
FIG. 25 is an isometric cutaway view of an example food and beverage tray consistent with certain embodiments of the present invention.

In the example embodiments shown, the main body of the tray 10 can be fabricated in two parts. The first part is the rim 150 as shown in FIG. 21 which incorporates the retaining members 120 as well as the side walls 112 with all movement of the retaining members 120 and side walls 112 being carried out by use of living hinges (i.e., thinner areas of the plastic that permit flexing). Note the hook element 154 which will be described later. The second part is the floor 46 as shown in FIG. 22 which incorporates the end walls 64, again with all movement of the end walls including the hinge 108 being carried out using living hinges. Other hinge mechanisms can also be used. The two main parts are assembled using screws, ultrasonic welding, snap connections or other techniques. The retaining pins 128 for legs 14 and 18 are put into place and the legs 14 or 18 as shown in isolation in FIG. 23 are dropped into their respective slots with hooks 124 facing the tray rim. Then, the retaining member 120, as shown in isolation in FIG. 24 is snapped into place by engaging latch members 132 to retain the legs 14 or 18. At this point or at any point in the assembly, one or more of the drink straps 30 can be inserted into place by pressing the buttons 90 into their respective receiving apertures with the fingers 34 facing the adjacent corner. FIG. 25 shows a cross sectional detail of a button 90 engaged in a mating aperture in the tray rim 150 shown in the dashed circle.

Figure 26:
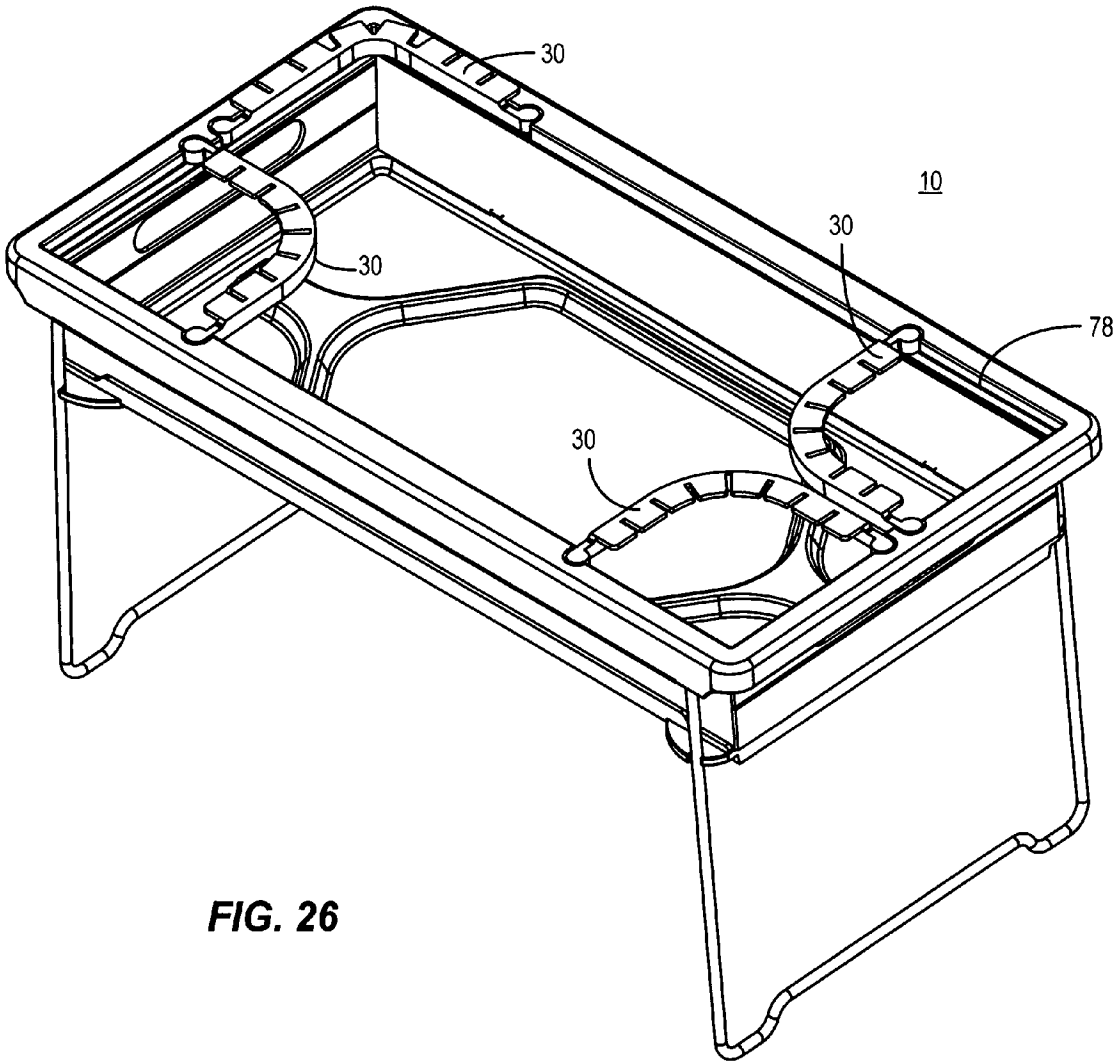
FIG. 26 is an isometric view of an example food and beverage tray showing one of the drink bands in the collapsed un-deployed position adjacent the corner in a manner consistent with certain embodiments of the present invention.

FIG. 26 depicts the tray 10 with three of the drink bands 30 deployed to carry a beverage with the fourth drink band 30 in the stowed position adjacent the corner. In the stowed position, the band 30 rests on the recessed ledge 78 to permit the tray portion to be maximized in size in this implementation.

Figures 27, 28:
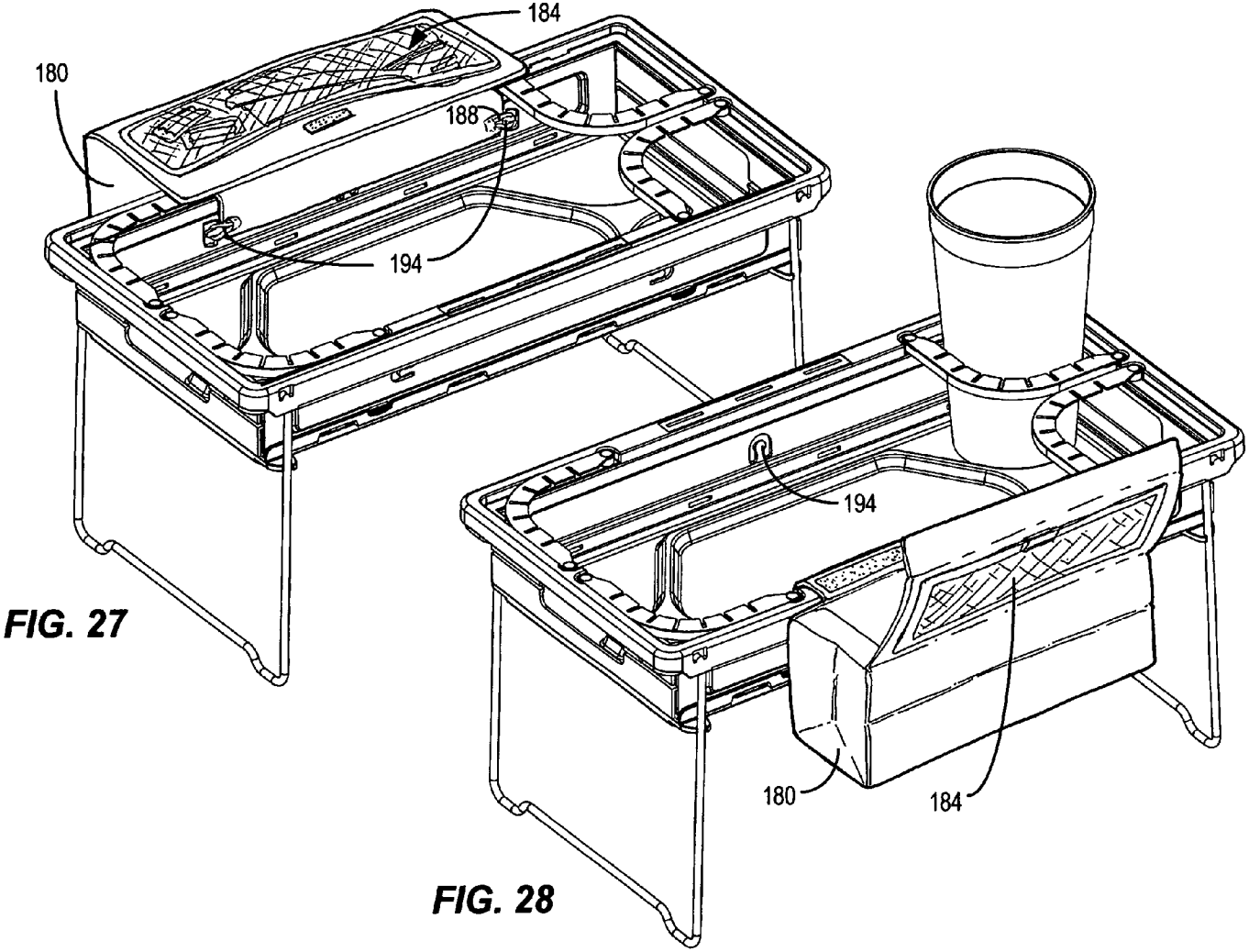
FIGS. 27-28 are a views of an example food and beverage tray having a storage bag attached and deployed in a manner consistent with certain embodiments of the present invention.

In accord with certain example embodiments, the versatility of the tray 10 can be enhanced by use of a storage bag 180 resembling a saddle bag shown deployed in FIGS. 27-28. Many variations are possible, but in these depictions, the storage bag may be a sewn storage bag made of fabric or may be made of fused plastic material. The storage bag 180 may have an integral silverware pouch 184, and may be insulated to carry hot or cold food items. The silverware pouch 184 may include multiple compartments so that both hot and cold food items can be separately maintained at appropriate temperature. A silverware pouch 184 can be provided on the storage bag 180 to separately carry silverware, condiment pouches, napkins, wet napkins or other items. The storage bags 180 attach when deployed using a pair of integral bungees 188 that clip to molded-in bungee hooks 194 on the side wall 112 of the tray 10 or other convenient location. The pouch and storage bag 180 can open and close using hook and loop fasteners, snaps, ties or other mechanisms.

The purpose of the saddle bag is to store additional food, for example. It's insulated sides keep the contents hot or cold. A mesh pocket on top can be used to store silverware, condiment packs, napkins, etc. The saddle bag hangs off the front of the tray away from the user. The lid can be sealed with hook and loop fasteners and opens away from the user to allow easy access.

Figure 29:
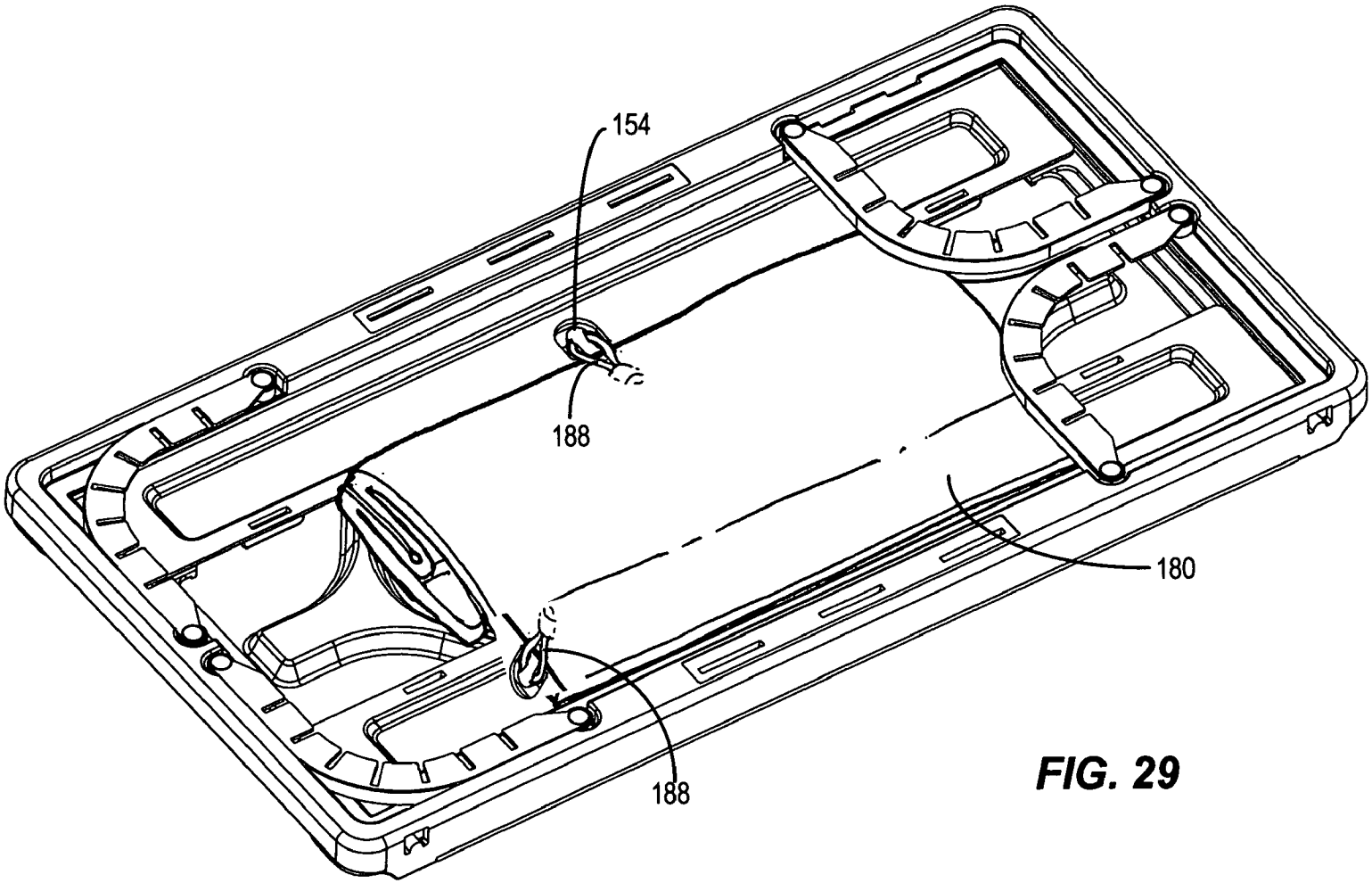
FIG. 29 are a views of an example food and beverage tray having a storage bag attached in a stowed position in a manner consistent with certain embodiments of the present invention.
Figures 30, 31:
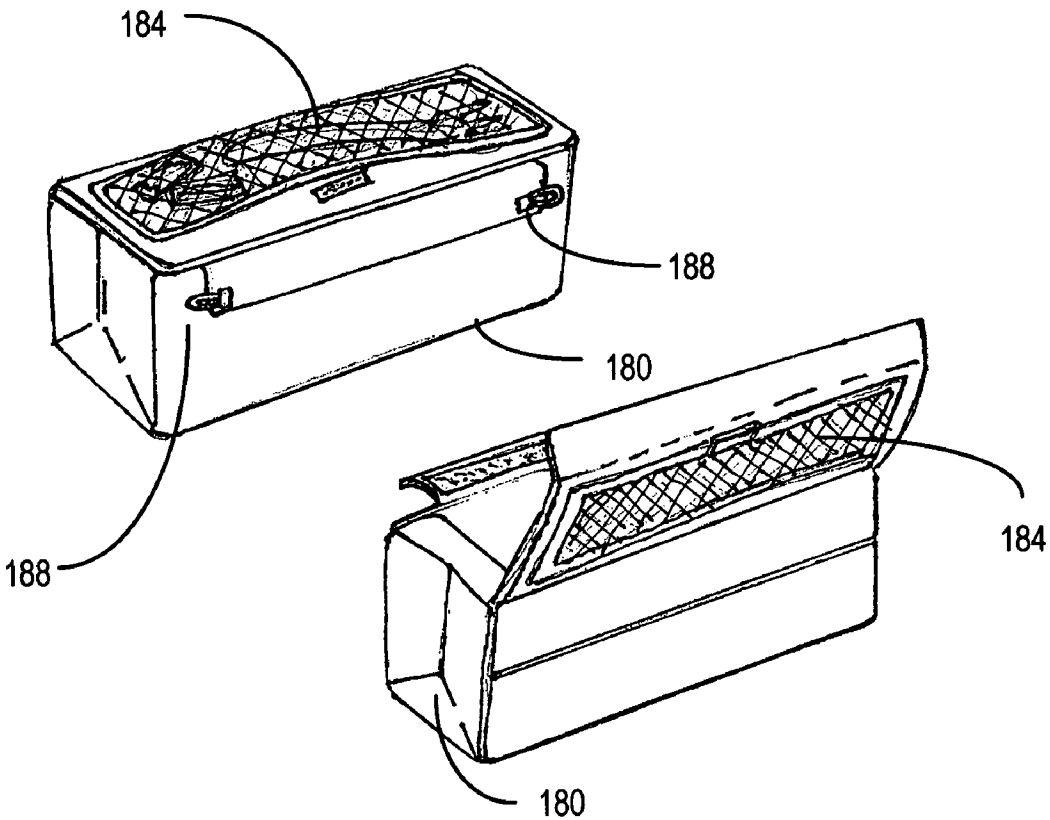
FIG. 30 and FIG. 31 depict a storage bag in the closed and open position in a manner consistent with certain embodiments of the present invention.

FIG. 29 depicts the storage bag stowed on a collapsed tray 10. The storage bag 180 is folded—in this implementation in the style of a conventional paper grocery store bag, and then folded over again to reveal a third bungee 188 that secures the storage bag 180 to the top side of the tray 10 by engaging hook element 154. Two views of example storage bags 180 with silverware pouches 184 are depicted in FIGS. 30 and 31. While not explicitly shown, the storage bags or pouches can also be outfitted with a logo or other decorative images on any desired surface thereof.

The saddle bag can be stored folded flat against the top of the tray. To open the saddle bag, the center bungee is unclipped and the saddle bag is rotated out. The saddle bag is removable attached to the try by using two bungee loops that hook onto molded-in features on the tray wall or other tray feature.

Thus, a food and beverage tray according to certain implementations has a tray having a bottom surface to support food and beverage items to be carried and walls extending upward therefrom to create an open box structure. The tray has at least one corner. A drink band has ends and is situated adjacent the corner and operative to rotate between an operative position (out or on) and a stowing position (in or off). The drink band has a plurality of finger-like structures that point generally toward the corner to steady a beverage cup of variable size by urging the beverage cup toward the corner. Wherein, the drink band is rotatable at each end so as to assume the operative position in which the beverage cup can be situated between the drink band and the corner, and wherein the drink band is rotatable from the operative position to the stowed position wherein the drink band approximately conforms to a shape of the corner.

In certain implementations, the bottom surface of the tray has a recessed portion adjacent the corner to accept a bottom portion of the beverage cup. In certain implementations, the walls of the tray collapse to reduce a height of the open box structure. In certain implementations, the walls include first and second opposing walls, and wherein the first opposing walls have a central hinge that folds when the walls collapse, and wherein the second opposing walls have an upper hinge that allows the second opposing walls to fold toward each other when the tray is collapsed. In certain implementations, a set of retractable legs that can support the tray when not retracted are provided. In certain implementations, the retractable legs are approximately U-shaped with hooks at each end of the U shape, and wherein the hooks rotate about a pin to go from an extended position approximately perpendicular to the tray bottom, to a position approximately parallel to the tray bottom, and slides into a recessed chamber within the tray to fully retract. In certain implementations, the tray has a plurality of corners with drink bands as described situated adjacent each corner. In certain implementations, a storage bag is connected to the tray. In certain implementations, the storage bag is insulated.

Another food and beverage tray consistent with certain implementations has a tray having a bottom surface to support food and beverage items to be carried and walls extending upward therefrom to create an open box structure. A set of retractable legs can support the tray when not retracted, wherein the retractable legs are approximately U-shaped with hooks at each end of the U shape, and wherein the hooks rotate about a pin to go from an extended position approximately perpendicular to the tray bottom, to a position approximately parallel to the tray bottom, and slides into a recessed chamber within the tray to fully retract.

In certain implementations, the tray has at least one corner, and a drink band having ends, the band being situated adjacent the corner and operative to rotate between an operative position and a stowing position. In certain implementations, the drink band has a plurality of finger-like structures that point generally toward the corner to steady a beverage cup of variable size by urging the beverage cup toward the corner. In certain implementations, the drink band is rotatable at each end so as to assume the operative position in which the beverage cup can be situated between the drink band and the corner, and wherein the drink band is rotatable from the operative position to the stowed position wherein the drink band approximately conforms to a shape of the corner. In certain implementations, the bottom surface of the tray has a recessed portion adjacent the corner to accept a bottom portion of the beverage cup. In certain implementations, the walls of the tray collapse to reduce a height of the open box structure. In certain implementations, the walls have first and second opposing walls, and the first opposing walls have a central hinge that folds when the walls collapse and the second opposing walls have an upper hinge that allows the second opposing walls to fold toward each other when the tray is collapsed. In certain implementations, a storage bag can be connected to the tray. In certain implementations, the storage bag is insulated.

Another food and beverage tray has a tray having a bottom surface to support food and beverage items to be carried. The tray has first and second opposing walls extending upward therefrom to create an open box structure. The walls of the tray collapse to reduce a height of the open box structure. The first opposing walls have a central hinge that folds when the walls collapse, and the second opposing walls have an upper hinge that allows the second opposing walls to fold toward each other when the tray is collapsed.

In certain implementations, the tray has at least one corner. A drink band has ends and is situated adjacent the corner and is operative to rotate between an operative position and a stowing position. The drink band has a plurality of finger-like structures that point generally toward the corner to steady a beverage cup of variable size by urging the beverage cup toward the corner. The drink band is rotatable at each end so as to assume the operative position in which the beverage cup can be situated between the drink band and the corner. The drink band is rotatable from the operative position to the stowed position wherein the drink band approximately conforms to a shape of the corner.

In certain implementations, the bottom surface of the tray has a recessed portion adjacent the corner to accept a bottom portion of the beverage cup. In certain implementations, a set of retractable legs are provided that can support the tray when not retracted. In certain implementations, the retractable legs are approximately U-shaped with hooks at each end of the U shape, and wherein the hooks rotate about a pin to go from an extended position approximately perpendicular to the tray bottom, to a position approximately parallel to the tray bottom, and slides into a recessed chamber within the tray to fully retract. In certain implementations, the tray has a plurality of corners with drink bands as described situated adjacent each corner. In certain implementations, a storage bag can be connected to the tray. In certain implementations, the storage bag is insulated.

Another food and beverage tray consistent with certain implementations has a tray having a bottom surface to support food and beverage items to be carried and walls extending upward therefrom to create an open box structure. The tray is approximately rectangular in overall shape with four corners. Four drink bands are provided, one adjacent each of the four corners. The four drink bands each have ends and are situated adjacent each corner and operative to rotate between an operative position and a stowing position. The four drink bands have a plurality of finger-like structures that point generally toward the corner to steady a beverage cup of variable size by urging the beverage cup toward the adjacent corner. Each of the four drink bands is rotatable at each end so as to assume the operative position in which the beverage cup can be situated between the drink band and the corner. Each of the four drink bands is rotatable from the operative position to the stowed position wherein each of the four drink bands approximately conforms to a shape of the corner. The bottom surface of the tray has a recessed portion adjacent the corner to accept a bottom portion of the beverage cup. The walls of the tray collapse to reduce a height of the open box structure. A set of retractable legs are provided that can support the tray when not retracted.

In certain implementations, the walls are first and second opposing walls, and the first opposing walls have a central hinge that folds when the walls collapse and the second opposing walls have an upper hinge that allows the second opposing walls to fold toward each other when the tray is collapsed. In certain implementations, the retractable legs are approximately. U-shaped with hooks at each end of the U shape, and wherein the hooks rotate about a pin to go from an extended position approximately perpendicular to the tray bottom, to a position approximately parallel to the tray bottom, and slides into a recessed chamber within the tray to fully retract. In certain implementations, a storage bag connected to the tray, wherein the storage bag is insulated.

A food and beverage tray in various implementations has one or more of drink bands, retractable legs and/or a collapsing tray assembly.

Additional Embodiments

Many alternatives and variations will occur to those skilled in the art upon consideration of the present teachings. After preparation of several prototypes, structural and mold flow analysis of the present food and beverage tray, several alternative implementations have evolved which will be described below.

Figure 32:
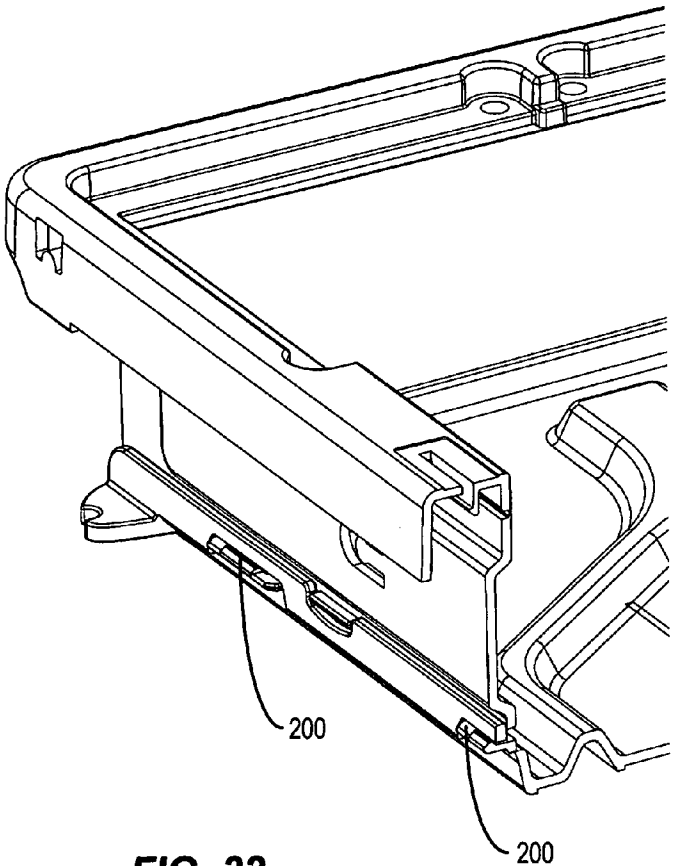
FIG. 32 depicts a sectional view of side wall snaps that are used to lock the walls in place and support the floor in a manner consistent with certain embodiments of the present invention.

With reference to FIG. 32, which details a sectional view of side wall snaps 200 that are used to lock the walls in place and support the floor 46. This has been found to enhance the stability of the floor of the tray and provides the advantage of a reduced tendency of racking when the walls are deployed, and is especially helpful when the legs are also deployed and locked into place in the fully rotated position.

Figure 33:
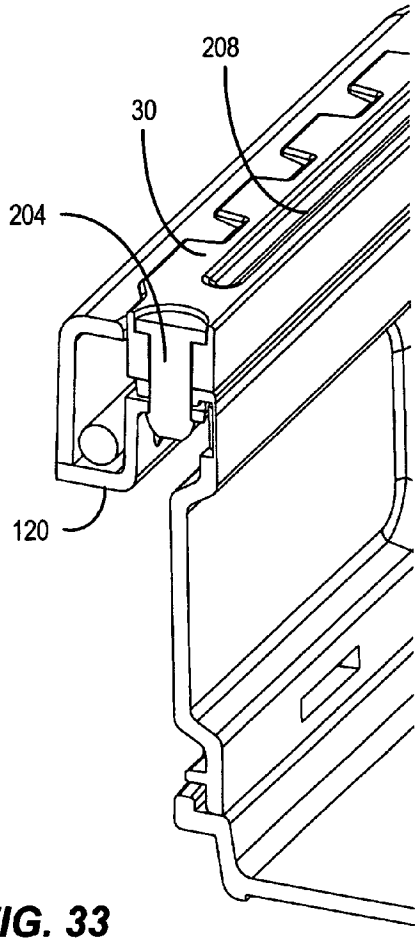
FIG. 33 is a sectional view that depicts use of a plastic rivet 204 that is installed from the top and passes through the drink band 30 and engages the underside upper rim in a manner consistent with certain embodiments of the present invention.

With reference to FIG. 33, a sectional view depicts use of a plastic rivet 204 that is installed from the top and passes through the drink band 30 and engages the underside upper rim (variously referred to herein as trough, ridge or ledge) 78. On one end of the drink band 30, the rivet also serves to capture the leg retaining members 120 (i.e., the leg covers) and affix them to the rim 78. Also shown is a groove at the upper surface of the drink band 30 which is used to mask sink marks (which are depressions or other irregularities that result from inconsistent cooling of the parts when extracted from the mold).

Figure 34:
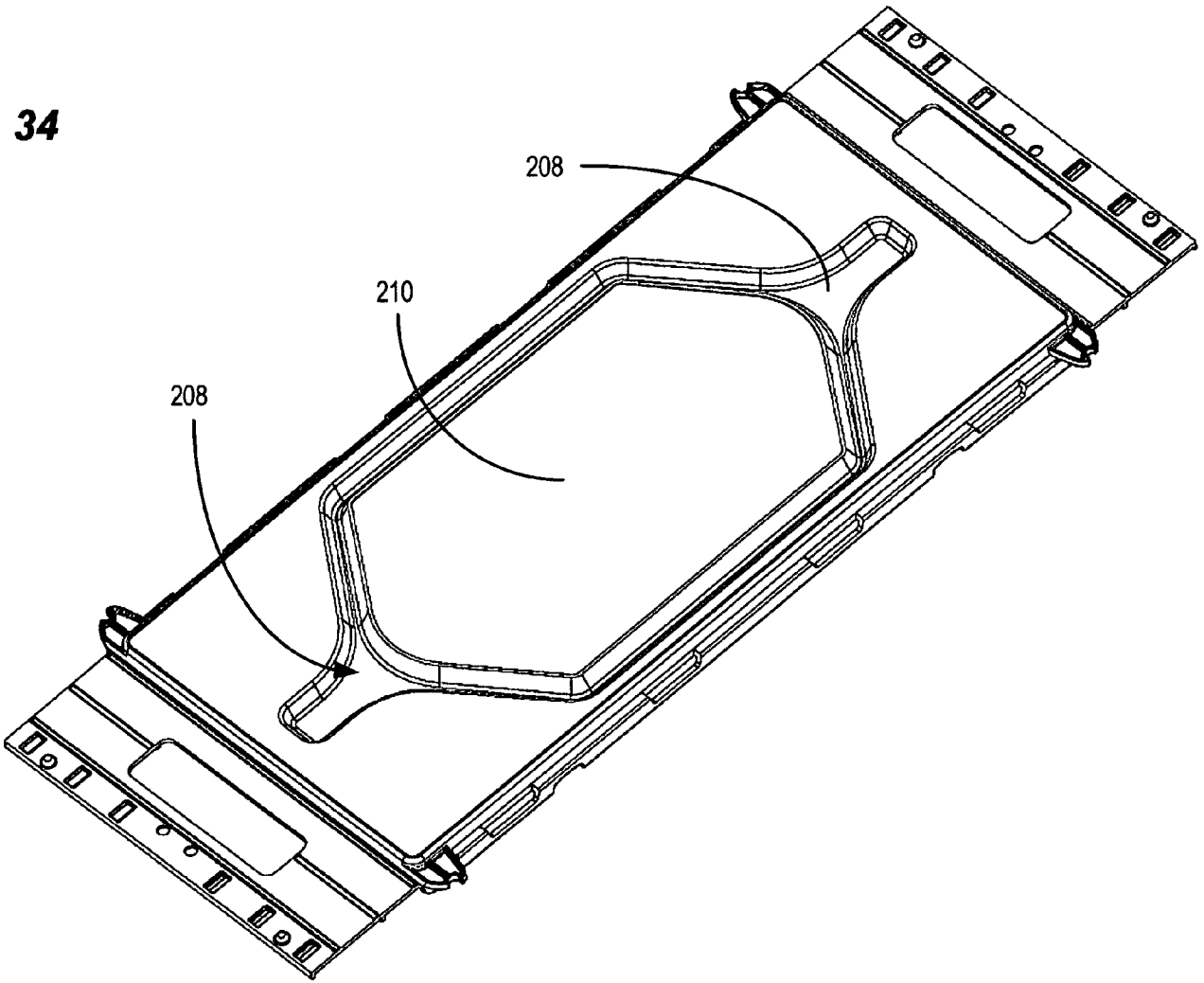
FIG. 34 is a view of the molded floor part is depicted with the removal of support ribs in a manner consistent with certain embodiments of the present invention.

With reference to FIG. 34, the molded floor part is depicted in its molded state with the removal of support ribs as shown, for example, in FIG. 11. These support ribs were found to be unnecessary for structural stability, but may be desirable in certain implementations in order to support a decal spanning the area 208. However, removal of the ribs enhances the ability to readily clean the tray 10. The tray can be decorated on the underside using a decal in the somewhat oval central area 210. To facilitate locating the decal, a locator rim can be provided around the periphery of the area 210. This provides tactile feedback and an edge to use as a guide when applying the decal if desired.

Figure 36:
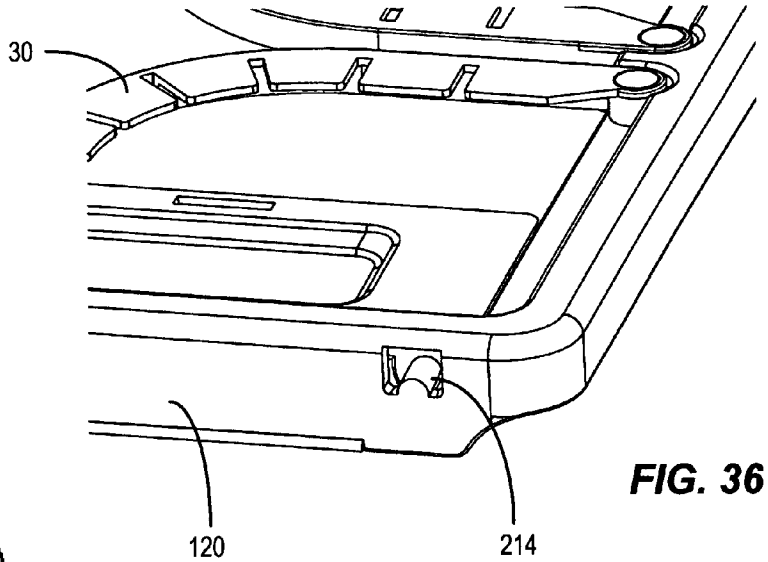
FIGS. 35 and 36 depict details of molded-in version of an axel pin used in an embodiment consistent with the present invention.
Figure 35:
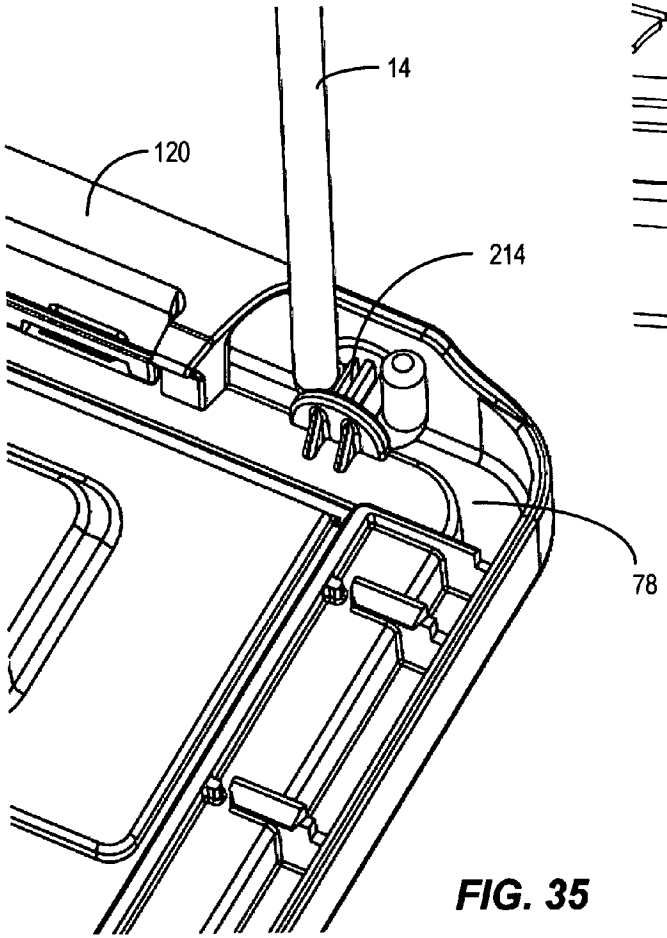

FIGS. 35 and 36 depict details of molded-in version of the axle pin 214. In FIG. 35, the axle pin 214 that the legs rotate about is shown from the underside of the rim 78. In FIG. 36, the axle pin 214 is shown as viewed from the side of the rim 78. The molded in version of the axle pin 214 can be used to replace the separate metal pins 128 as shown, for example in FIG. 20. While the metal pins 128 are likely more wear resistant, the plastic molded in axle pins 214 facilitate fewer separate parts, faster assembly and reduced cost, with minimal or no impact on the life of the pin under normal use. As with the metal pin 128, the legs 14 and 18 rotate about the pin to enable the legs to move between the various positions of deployment or storage.

Figure 37:
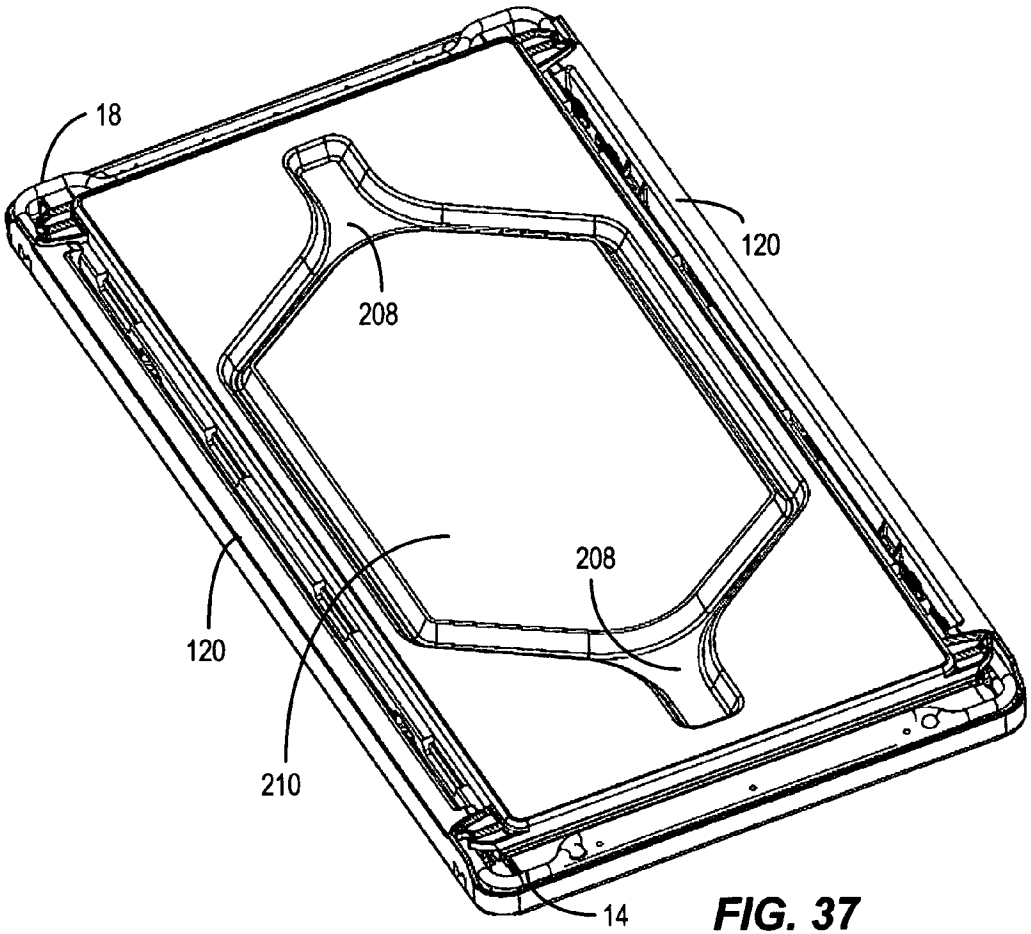
FIG. 37 is a general view of the underside of the full assembly of the food and beverage tray depicted in the closed consistent with certain implementations of the present inventions.

FIG. 37 is a general view of the underside of the full assembly of the food and beverage tray depicted in the "closed" position to demonstrate the four locking snaps used to secure the unit in the closed position for transport or storage.

Figure 38:
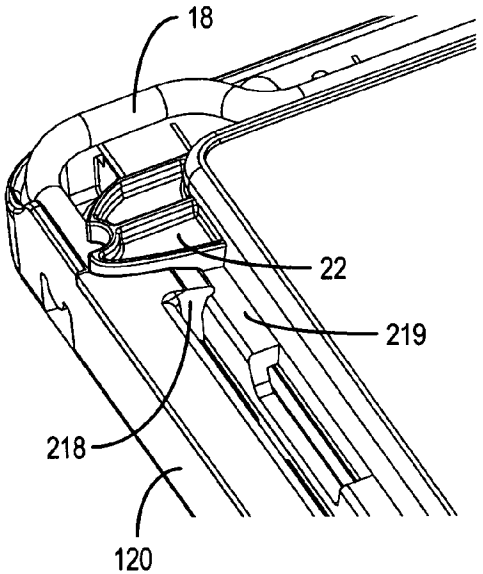
FIG. 38 is a detail view of one locking snap as it engages the underside of the floor in accord with certain embodiments consistent with the present invention.

FIG. 38 is a detail view of one locking snap, located on the leg cover 120 adjacent the locking elements 22, as it engages ledge 219 situated on the underside of the floor 46. In the closed position, the floor snaps gently into the rim using molded in plastic snaps 218 that form a part of the rim 78 part. Snaps 218 hold the tray closed by resisting the floor's tendency to snap open until the user desires to open the tray into the fully deployed position. Pressure applied in the direction that opens the tray overcomes the snaps and the tray begins to open to its fully open position.

Figure 39:
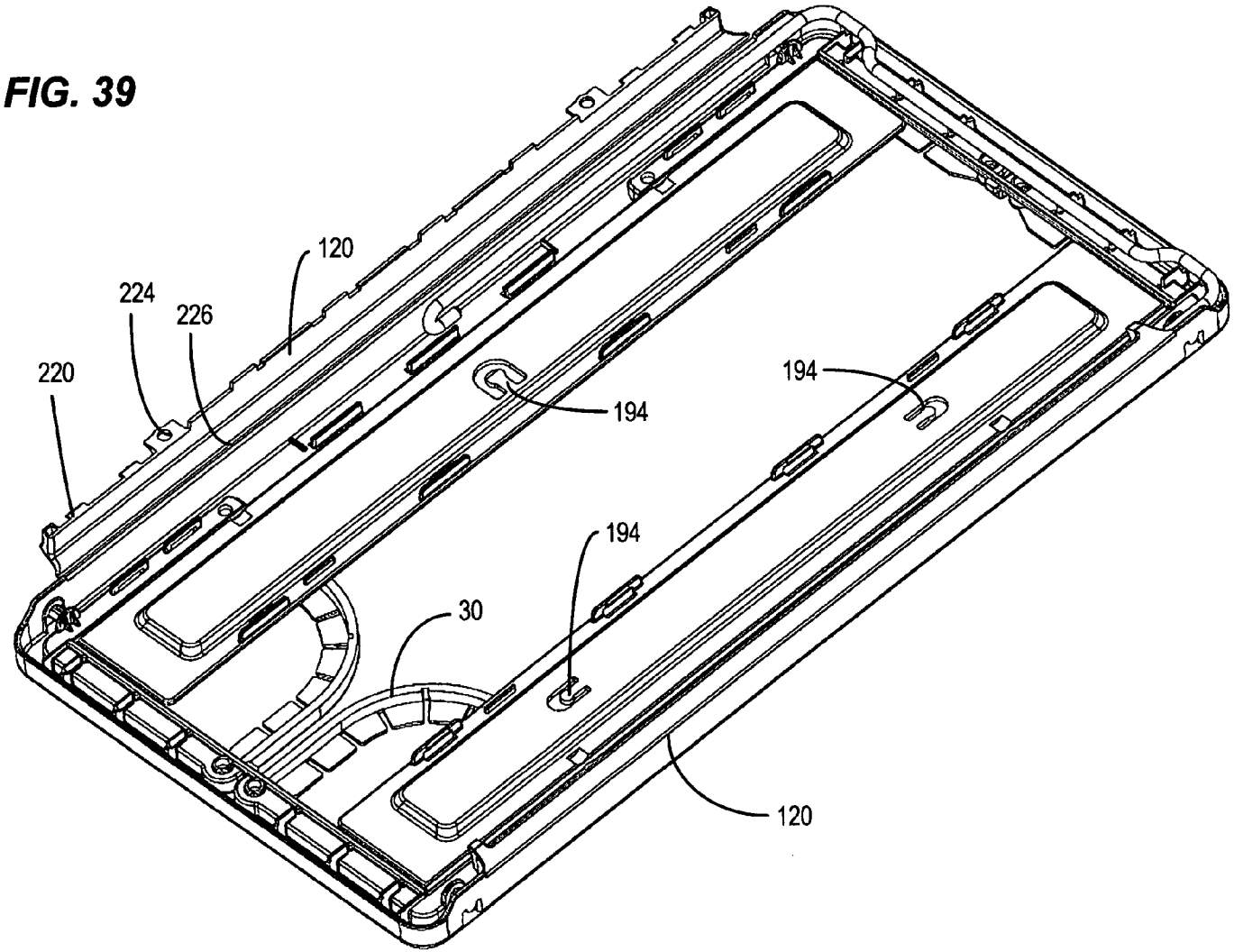
FIG. 39 depicts a general view of the underside of the rim sub-assembly showing the leg covers with one open and one closed in a manner consistent with the present invention.

FIG. 39 depicts a general view of the underside of the rim sub-assembly showing the leg covers 120 with one open and one closed. Each side panel preferably has a recessed area or other structure molded therein in order to provide rigidity over a flat side panel. The leg covers 120 operate with a living hinge and snap into place. The snap design locks the leg covers 120 closed with multiple molded-in snaps such as 220 and the drink band rivets 204 which pass through apertures 224 and 228 to lock into place. The leg covers 120 are molded into the same part as the rim 78 and is wrapped around the leg along a living hinge 226 running the length of the leg covers 120 and snaps into place to permit the leg covers to enclose the legs 18. This secures the legs 18 in the rim portion of the food and beverage tray.

Figure 40:
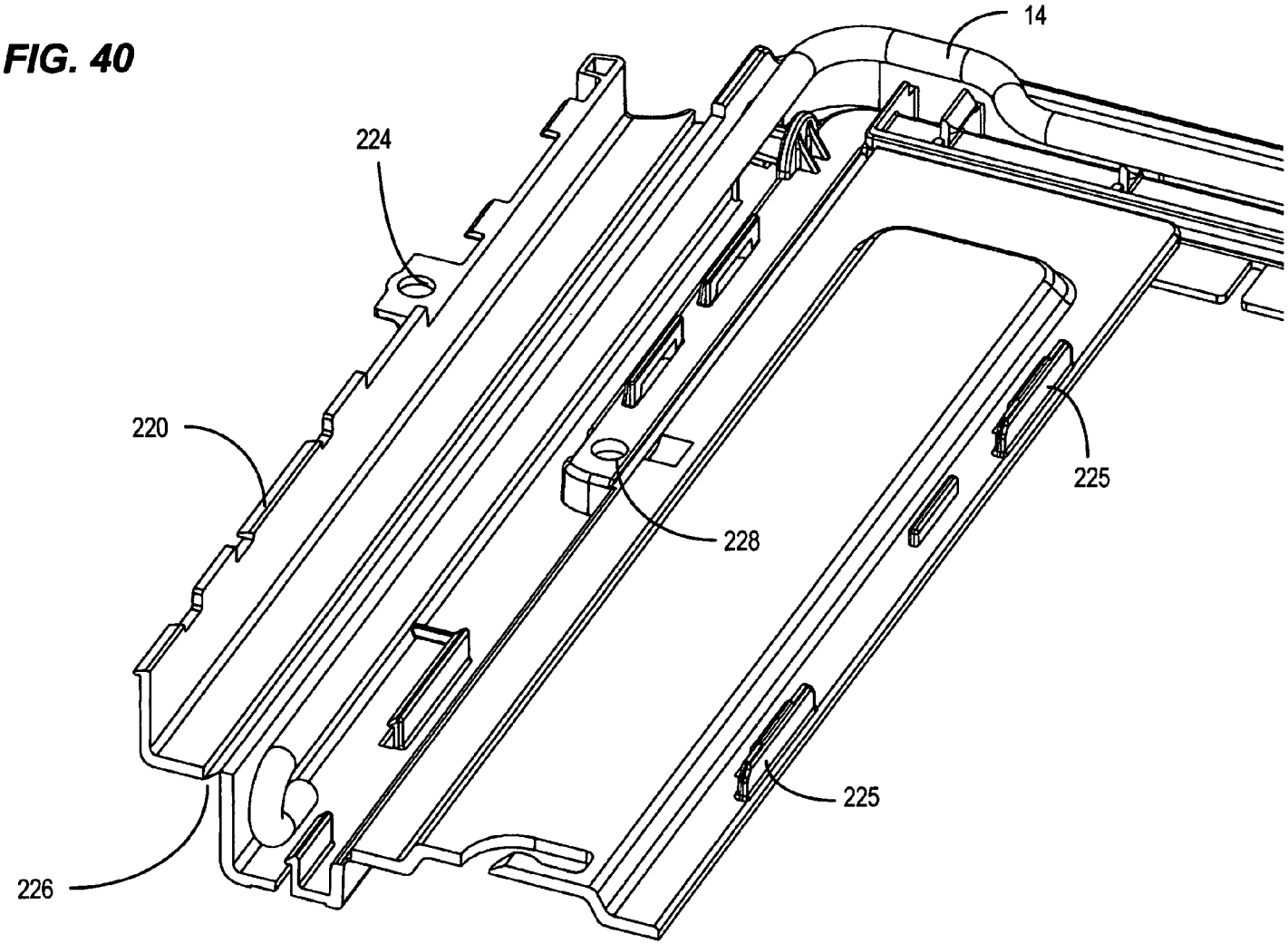
FIG. 40 is a detail of the leg cover in the open position consistent with the present invention.
Figure 41:
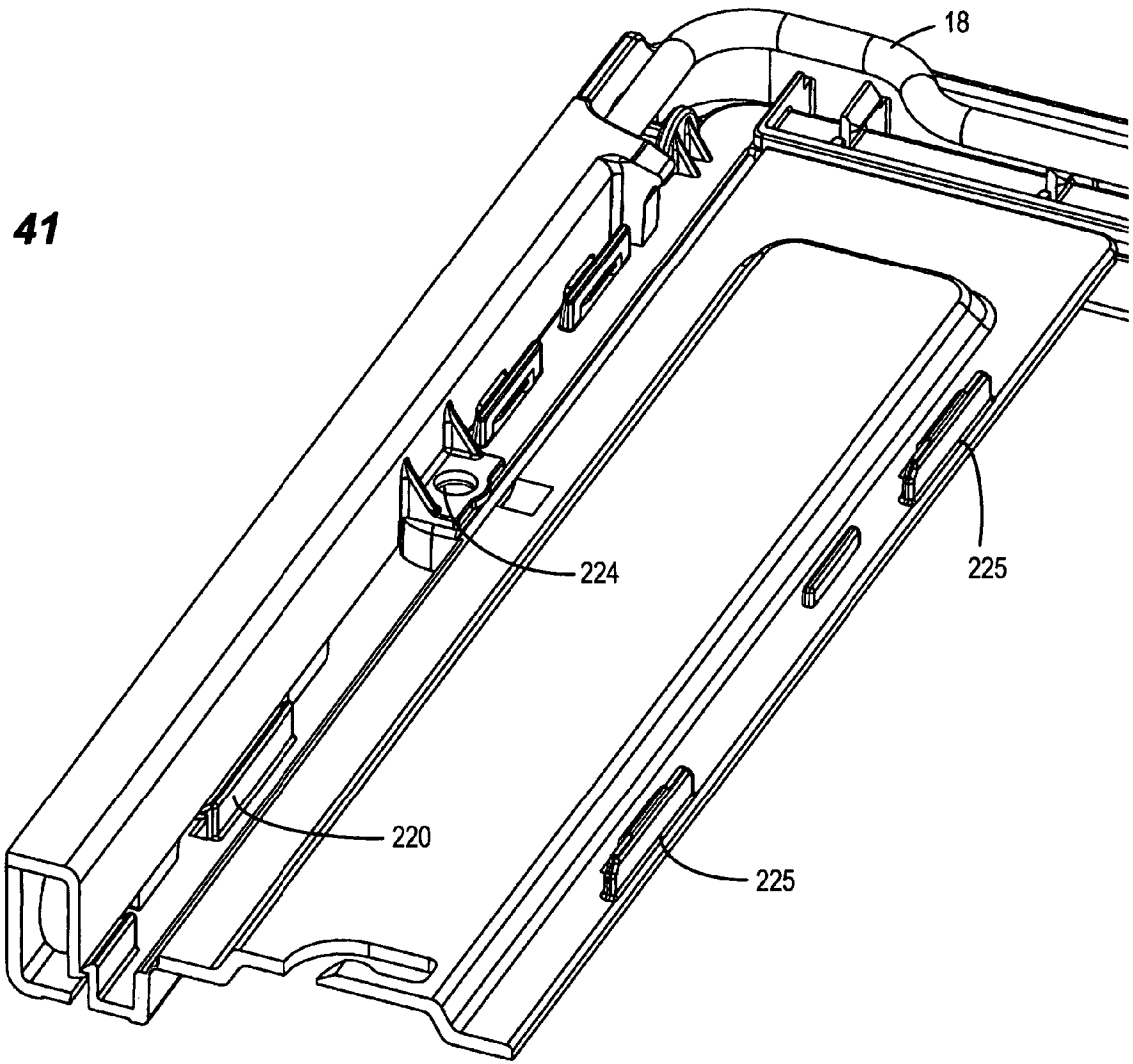
FIG. 41 is a detail of the leg cover in the closed position without the drink band rivets but with the snaps engaged in a manner consistent with the present invention.

FIG. 40 is a detail of the leg cover 120 in the open position. FIG. 41 is a detail of the leg cover 120 in the closed position without the drink band rivets 204 but with the snaps 220 engaged. Also shown are snaps 225 which engage in slots on the side of the floor to hold the sides in place and support the floor to resist sagging by virtue of placing the structure in both shear and tension forces.

Figure 42:
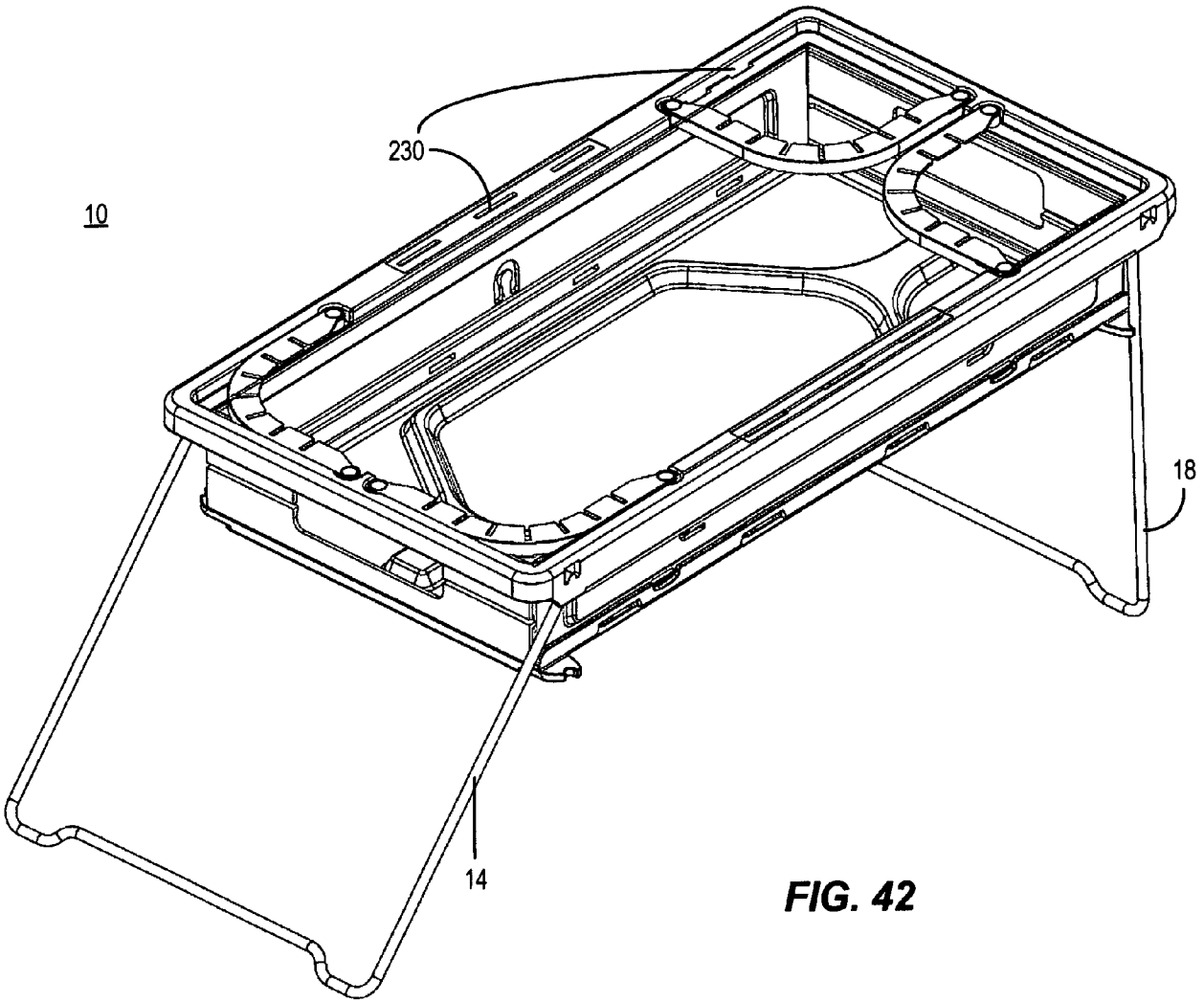
FIG. 42 is an overall view of the tray with one leg fully deployed and the other leg partially deployed in a manner consistent with embodiments of the present invention.

FIG. 42 is an overall view of the tray 10 with one leg 18 fully deployed and the other leg 14 partially deployed. Slots such as 230 are provided at the top of the rim 78 to facilitate tooling. These slots 230 can be covered with a decal if desired to hide their appearance, and the rim can be provided with locator rims if desired to facilitate placement of such decals. It is noted that the legs can be simply extended so as to bridge an object such as a bathtub's walls when both legs are simply extended along the plane of the tray without rotation downward.

Figure 43:
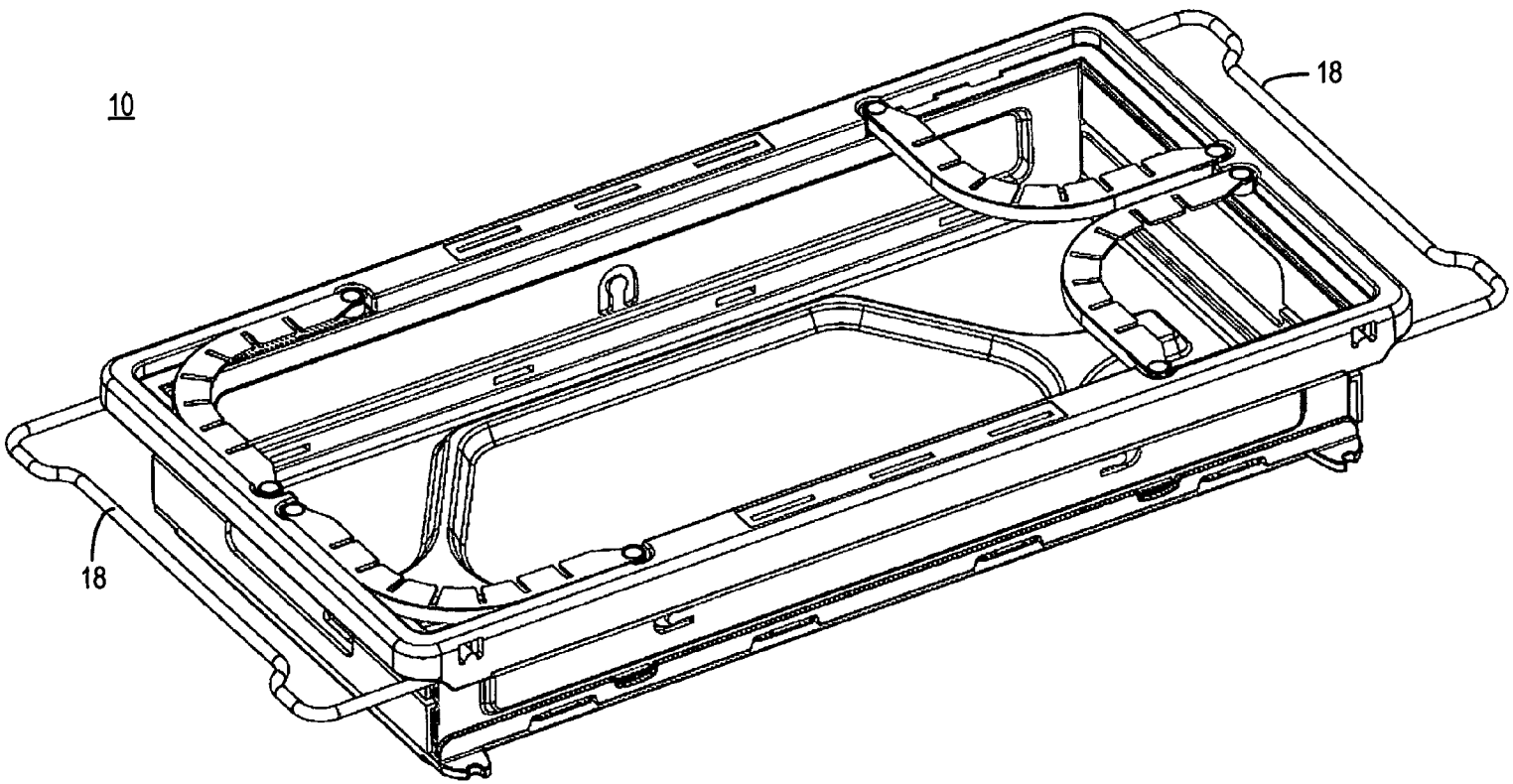
FIG. 43 depicts the legs at one end partially extended in order to utilize the leg as a handle in accord with embodiments consistent with the present invention.

FIG. 43 depicts the legs 18 at one end partially extended in order to utilize the leg as a handle. This is accomplished by causing the leg 18 to stop at a protuberance serving as a stop member within the recessed chamber that affixes the legs at an intermediate position to permit the leg to extend short of the fully retracted position such that the leg can be used as a handle. In one implementation, the leg extends approximately two inches to reach this intermediate position to make a handle.

Figure 44:
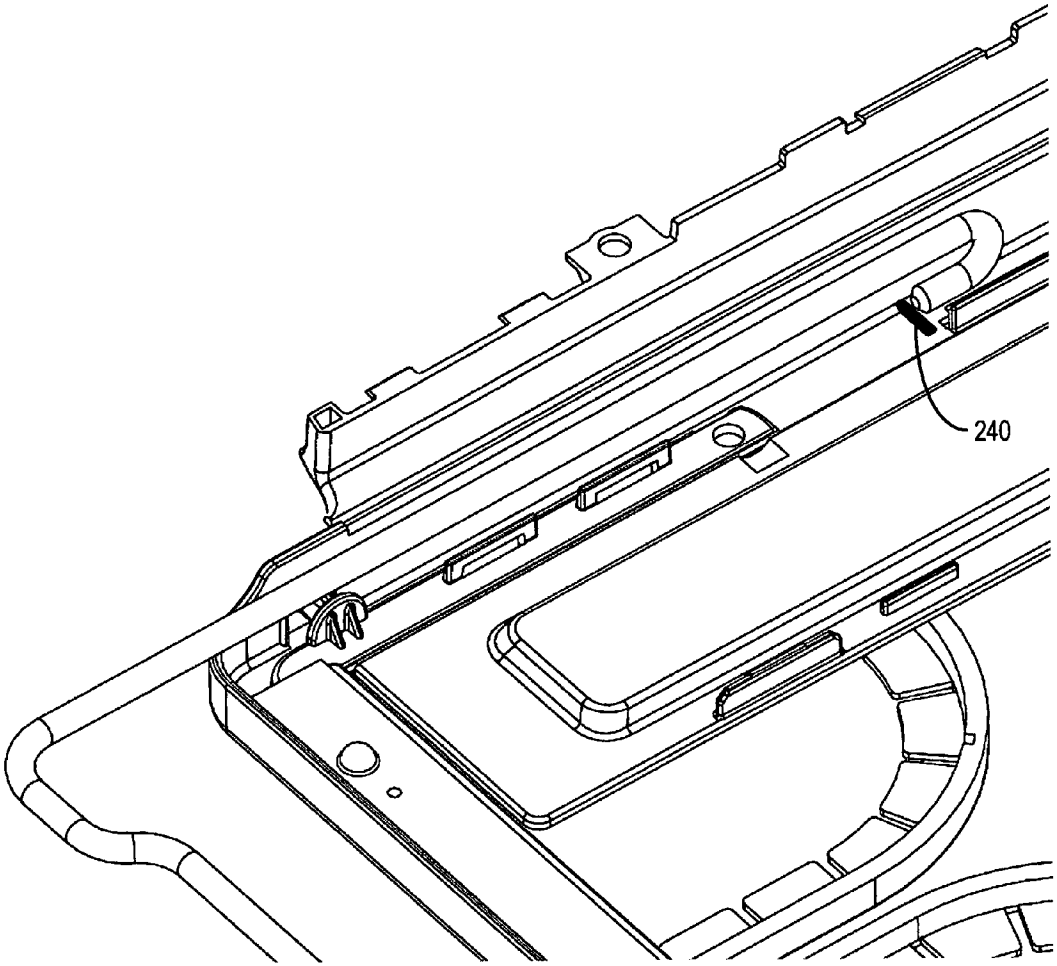
FIG. 44 shows a protuberance which is molded to the underside of the rim to form a stop that engages the leg at an intermediate position in accord with embodiments consistent with the present invention.

FIG. 44 shows protuberance 240 which is molded to the underside of the rim 78 inside the leg cover chamber such that when the leg 18 is extended by about two inches or so, the hooked end of the leg engages the protuberance 240 serving as a stop so that the leg extension halts at that degree of extension. In this manner, the leg can be used as a handle in this intermediate position. By application of additional force to the leg 18, it will continue to extend beyond the stop member to enable full deployment of the legs by rotation about the pin 214 as previously described. The stop member may be molded as a bump, a ramp or other mechanical structure that stops the leg, but which stop can be overcome by exerting additional pressure on the leg.

Figure 46:
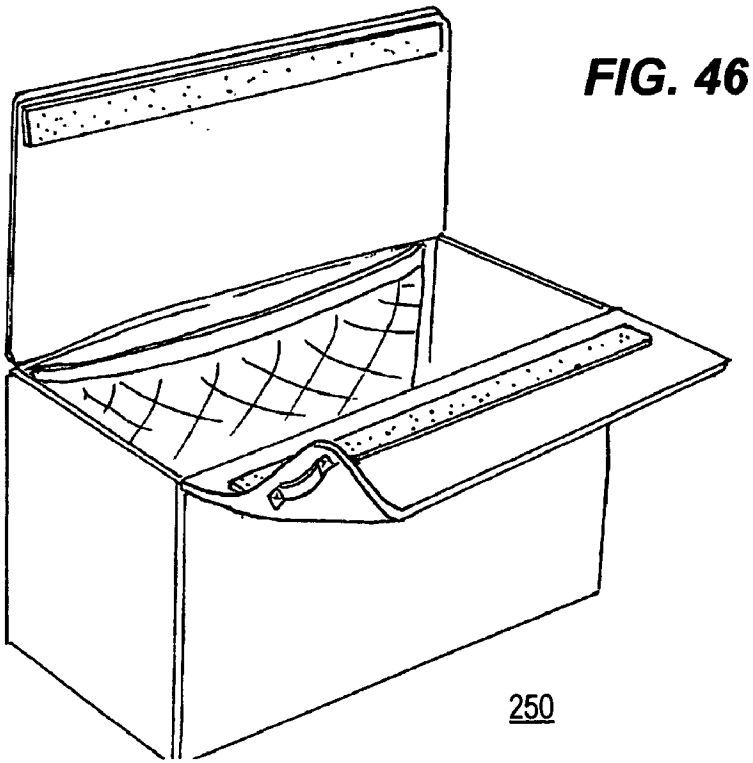
FIGS. 45 and 46 depict front and rear views of an alternative design of the saddle bag consistent with the present invention.
Figure 45:
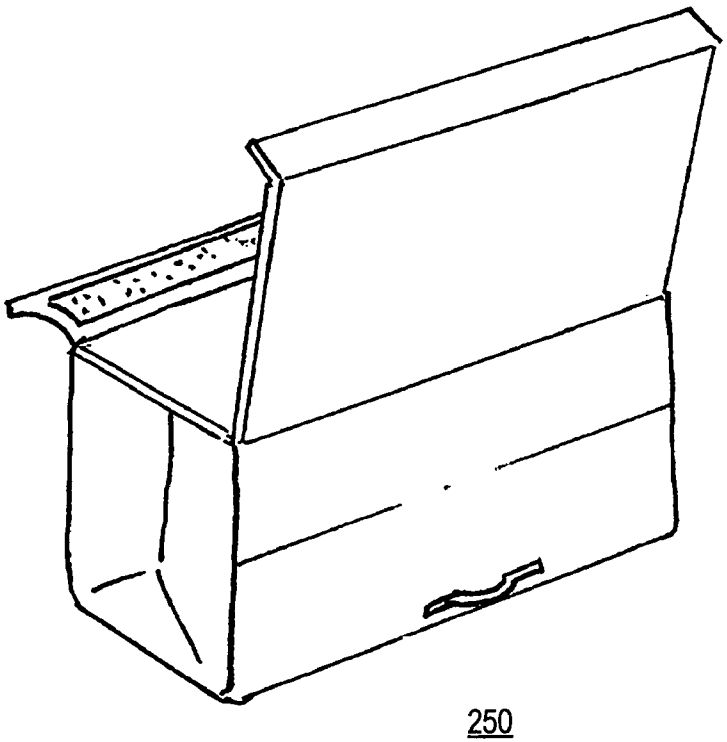

FIGS. 45 and 46 depict front and rear views of an alternative design of the saddle bag shown as 250. The saddle bags 250 can be sewn or otherwise constructed, e.g., using vinyl and radio frequency welding or other suitable techniques. In this design, an internal bag in a separate partition can be provided rather than external as previously shown. The bag can again be attached to the tray 10 by bungees as previously depicted, and hook and loop fasteners can be used to open and close the bags.

Figures 47, 48:
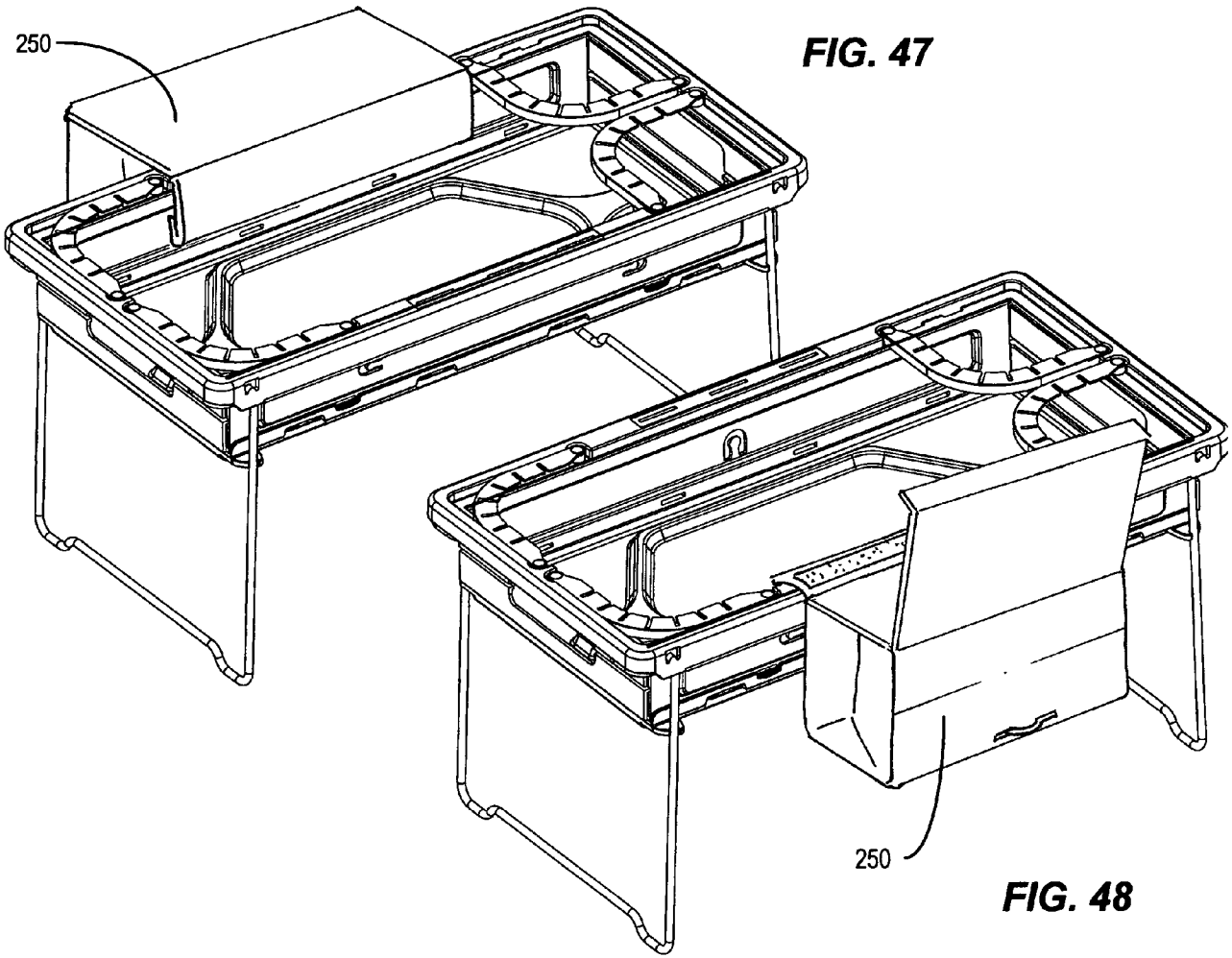
FIGS. 47 and 48 depict front and rear views of the alternative design of the saddle bag installed on the food and beverage tray on the open position in a manner consistent with the present invention.

FIGS. 47 and 48 depict front and rear views of an alternative design of the saddle bag 250 installed on the food and beverage tray on the open position. When the bags are deployed, the bungee connection at the bottom is unhooked and the bag flipped over so as to hang from the rear of the tray.

Figure 49:
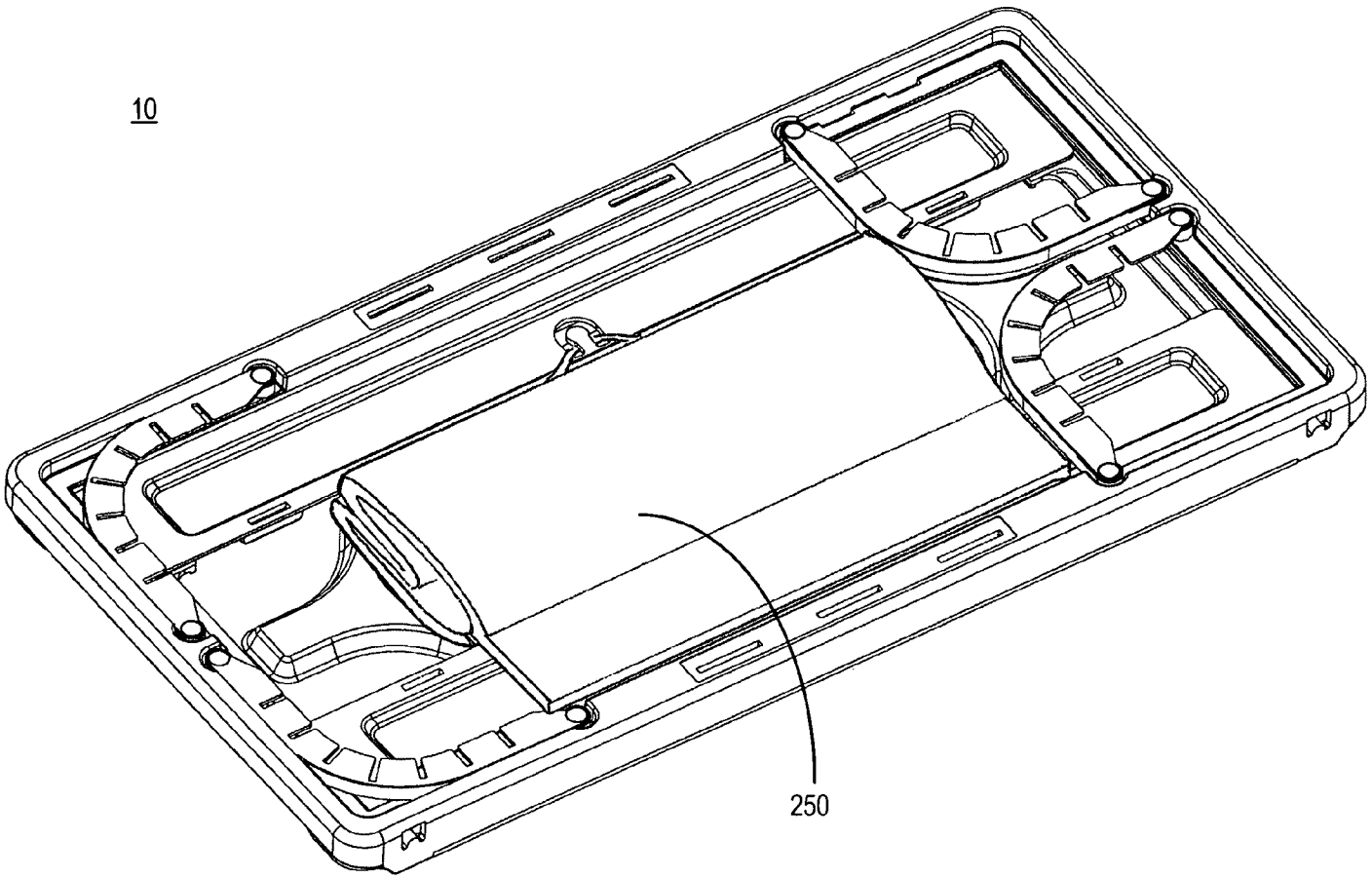
FIG. 49 depicts a view of the alternative design saddle bag in the stowed position on the tray in a manner consistent with the present invention.

FIG. 49 depicts a view of the alternative design saddle bag 250 in the stowed position on the tray 10. In this position, all three bungee connections are utilized. Other variations for saddle bags will occur to those skilled in the art upon consideration of the present teachings without departing from embodiments consistent with the present invention.

Certain of the prototypes were found to float which may be advantageous in using the tray in a pool setting. Additionally, due to the recesses in the floor of the tray, minor spills are retained within the tray to facilitate cleanup and limit spillover onto floors, etc. While not shown, anti-skid pads or feet can be affixed to the underside of the tray floor to make the tray less vulnerable to sliding about. It is also noted that in the alternative embodiments depicted, all screws have been eliminated in favor of snaps that reduce the assembly labor, number of parts and simplifies assembly. The legs can be zinc plated or galvanized steel in certain implementations.

Many other alternatives and variations will occur to those skilled in the art upon consideration of the present teachings. For example, while an overall rectangular profile is preferred, variations in the shape are possible. Four drink bands, one in each corner are depicted, but other variations are possible. Other techniques such as screws can also be used to retain the drink bands. The particular materials described are not necessarily required, but it is desired that the tray be durable and provide for multiple uses so as to minimize the need for use of disposable trays and their associated cleanup. While the end walls are shown with a central hinge and the side wall rotates from the top, other variations are possible, such as the side walls having the central hinge and the end walls rotating from the top. The arrangement of drink bands with a collapsible tray and folding legs is depicted, but any or all of the components can be used in various combinations without departing from the spirit and scope of implementations consistent with the present invention. Accessory bag attachments such as storage bags can be provided and attached to the tray in various ways, and the bags may be insulating if desired. The storage bags can have multiple insulated or un-insulated compartments and can have exterior or interior pouches (e.g., mesh pouches). Other variations will occur to those skilled in the art upon consideration of the present teachings.

While certain illustrative embodiments have been described, it is evident that many alternatives, modifications, permutations and variations will become apparent to those skilled in the art in light of the foregoing description.

What is claimed is:

1. A food and beverage tray, comprising:

a tray having a bottom surface to support food and beverage items to be carried and walls extending upward therefrom to create an open box structure;

the tray having at least one corner;

a drink band having ends and situated adjacent the corner and operative to rotate between an operative position that forms an opening for a beverage cup of variable size and a stowing position;

the drink band having a plurality of finger-like structures that point generally toward the opening when in the operative position to steady the beverage cup by urging the beverage cup toward the corner; and where, the drink band is rotatable at each end so as to assume the operative position in which the beverage cup can be situated in the opening between the drink band and the corner, and where the drink band is rotatable from the operative position to the stowed position wherein the drink band approximately conforms to a shape of the corner.

2. The food and beverage tray according to claim 1, where the bottom surface of the tray has a recessed portion adjacent the corner to accept a bottom portion of the beverage cup.

3. The food and beverage tray according to claim 1, where the walls of the tray collapse to reduce a height of the open box structure.

4. The food and beverage tray according to claim 3, where the walls comprise first and second opposing walls, and wherein the first opposing walls have a central hinge that folds when the walls collapse, and wherein the second opposing walls have an upper hinge that allows the second opposing walls to fold toward each other when the tray is collapsed.

5. The food and beverage tray according to claim 1, further comprising a set of retractable legs that can support the tray when not retracted.

6. The food and beverage tray according to claim 5, where the retractable legs are approximately U-shaped with hooks at each end of the U shape, and where the hooks rotate about a pin to go from an extended position approximately perpendicular to the tray bottom, to a position approximately parallel to the tray bottom, and slides into a recessed chamber within the tray to fully retract.

7. The food and beverage tray according to claim 6, where the recessed chamber forms a leg cover that covers the legs when the legs are fully retracted, the recessed chamber being molded as a part of a rim portion of the tray which is folded at a living hinge running a length of the leg cover and snaps into place to form the recessed chamber.

8. The food and beverage tray according to claim 5, where the retractable legs are approximately U-shaped with hooks at each end of the U shape, and where the hooks rotate about a pin to go from an extended position approximately perpendicular to the tray bottom, to a position approximately parallel to the tray bottom, and slides into a recessed chamber within the tray to fully retract, and where the legs stop at a stop member in the recessed chamber that affixes the legs at an intermediate position to permit the leg to extend short of the fully retracted position such that the leg can be used as a handle.

9. The food and beverage tray according to claim 1, where the tray has a plurality of corners with drink bands as described situated adjacent each corner.

10. The food and beverage tray according to claim 9, where the saddle bag is insulated.

11. The food and beverage tray according to claim 1, further comprising a saddle bag connected to the tray.

12. A food and beverage tray, comprising:

a tray having a bottom surface to support food and beverage items to be carried walls extending upward therefrom to create an open box structure; and a set of retractable legs that can support the tray when not retracted, wherein the retractable legs are approximately U-shaped with hooks at each end of the U shape, and wherein the hooks rotate about a pin to go from an extended position approximately perpendicular to the tray bottom, to a position approximately parallel to the tray bottom, and slides into a recessed chamber within the tray to fully retract; the tray has at least one corner; a drink band having ends and situated adjacent the corner and operative to rotate between an operative position that forms an opening for a beverage cup of variable size and a stowing position; the drink band having a plurality of finger-like structures that point generally toward the opening when in the operative position to steady a beverage cup by urging the beverage cup toward the corner; where the drink band is rotatable at each end so as to assume the operative position in which the beverage cup can be situated in the opening between the drink band and the corner, and where the drink band is rotatable from the operative position to the stowed position where the drink band approximately conforms to a shape of the corner; and where the bottom surface of the tray has a recessed portion adjacent the corner to accept a bottom portion of the beverage cup.

13. The food and beverage tray according to claim 12, where the recessed chamber forms a leg cover that covers the legs when the legs are fully retracted, the recessed chamber being molded as part of a rim portion of the tray which is folded at a living hinge running a length of the leg cover and snaps into place to form the recessed chamber.

14. The food and beverage tray according to claim 12, where the walls of the tray include a living hinge about which the walls collapse to reduce a height of the open box structure.

15. The food and beverage tray according to claim 14, where the walls comprise first and second opposing walls, and where the first opposing walls have a central hinge that folds when the walls collapse, and where the second opposing walls have an upper hinge that allows the second opposing walls to fold toward each other when the tray is collapsed.

16. The food and beverage tray according to claim 12, further comprising a saddle bag connected to the tray.

17. The food and beverage tray according to claim 16, where the saddle bag is insulated.

18. The food and beverage tray according to claim 12, where the legs stop at a stop member in the recessed chamber that affixes the legs at an intermediate position to permit the leg to extend short of the fully retracted position such that the leg can be used as a handle.

19. A food and beverage tray, comprising:

a tray having a bottom surface to support food and beverage items to be carried;

the tray having first and second opposing walls extending upward therefrom to create an open box structure;

where the walls of the tray collapse to reduce a height of the open box structure, where the first opposing walls have a central hinge that folds when the walls collapse, and where the second opposing walls have an upper hinge that allows the second opposing walls to fold toward each other when the tray is collapsed; the tray having at least one corner; a drink band having ends and situated adjacent the corner and operative to rotate between an operative position that forms an opening for a beverage cup of variable size and a stowing position; the drink band having a plurality of finger-like structures that point generally toward the corner to steady the beverage cup by urging the beverage cup toward the corner; and where the drink band is rotatable at each end so as to assume the operative position in which the beverage cup can be situated between the drink band and the corner, and where the drink band is rotatable from the operative position to the stowed position where the drink band approximately conforms to a shape of the corner.

20. The food and beverage tray according to claim 19, wherein the bottom surface of the tray has a recessed portion adjacent the corner to accept a bottom portion of the beverage cup.

21. The food and beverage tray according to claim 19, further comprising a set of retractable legs that can support the tray when not retracted.

22. The food and beverage tray according to claim 21, where the retractable legs are approximately U-shaped with hooks at each end of the U shape, and where the hooks rotate about a pin to go from an extended position approximately perpendicular to the tray bottom, to a position approximately parallel to the tray bottom, and slides into a recessed chamber within the tray to fully retract.

23. The food and beverage tray according to claim 22, where the recessed chamber forms a leg cover that is molded into a rim portion which wraps around the leg along a living hinge running a length of the leg cover and snaps into place to permit the leg cover to enclose the leg.

24. The food and beverage tray according to claim 21, where the retractable legs are approximately U-shaped with hooks at each end of the U shape, and where the hooks rotate about a pin to go from an extended position approximately perpendicular to the tray bottom, to a position approximately parallel to the tray bottom, and slides into a recessed chamber within the tray to fully retract, and where the legs stop at a stop member in the recessed chamber that affixes the legs at an intermediate position to permit the leg to extend short of the fully retracted position such that the leg can be used as a handle.

25. The food and beverage tray according to claim 19, where the tray has a plurality of corners with drink bands as described situated adjacent each corner.

26. The food and beverage tray according to claim 19, further comprising a saddle bag connected to the tray.

27. The food and beverage tray according to claim 26, where the saddle bag is insulated.

28. A food and beverage tray, comprising:

a tray having a bottom surface to support food and beverage items to be carried and walls extending upward therefrom to create an open box structure;

the tray being approximately rectangular in overall shape with four corners;

four drink bands, one adjacent each of the four corners;

the four drink bands each having ends and situated adjacent each corner and operative to rotate between an operative position that forms an opening for a beverage cup of variable size and a stowing position;

the four drink bands each having a plurality of finger-like structures that point generally toward the opening at the adjacent corner when in the operative position to steady the beverage cup by urging the beverage cup toward the adjacent corner;

where, each of the four drink band is rotatable at each end so as to assume the operative position in which the beverage cup can be situated in the opening between the drink band and the adjacent corner, and where each of the four drink bands is rotatable from the operative position to the stowed position where each of the four drink bands approximately conforms to a shape of the corner;

where the bottom surface of the tray has a recessed portion adjacent the corner to accept a bottom portion of the beverage cup;

where the walls of the tray collapse to reduce a height of the open box structure; and a set of retractable legs that can support the tray when not retracted.

29. The food and beverage tray according to claim 28, where the walls comprise first and second opposing walls, and where the first opposing walls have a central hinge that folds when the walls collapse, and where the second opposing walls have an upper hinge that allows the second opposing walls to fold toward each other when the tray is collapsed.

30. The food and beverage tray according to claim 28, where the retractable legs are approximately U-shaped with hooks at each end of the U shape, and where the hooks rotate about a pin to go from an extended position approximately perpendicular to the tray bottom, to a position approximately parallel to the tray bottom, and slides into a recessed chamber within the tray to fully retract.

31. The food and beverage tray according to claim 30, where the recessed chamber forms a leg cover that covers the legs when the legs are fully retracted, the recessed chamber being molded as part of a rim portion of the tray which is folded at a living hinge running a length of the leg cover and snaps into place to form the recessed chamber.

32. The food and beverage tray according to claim 28, where the retractable legs are approximately U-shaped with hooks at each end of the U shape, and where the hooks rotate about a pin to go from an extended position approximately perpendicular to the tray bottom, to a position approximately parallel to the tray bottom, and slides into a recessed chamber within the tray to fully retract, and where the legs stop at a stop member in the recessed chamber that affixes the legs at an intermediate position to permit the leg to extend short of the fully retracted position such that the leg can be used as a handle.

33. The food and beverage tray according to claim 28, further comprising a saddle bag connected to the tray, wherein the saddle bag is insulated.

* * * * *